US009193366B2

(12) United States Patent
Forbes

(10) Patent No.: US 9,193,366 B2
(45) Date of Patent: Nov. 24, 2015

(54) RAIL ROAD CAR DRAFT FITTINGS

(75) Inventor: James W. Forbes, Campbellville (CA)

(73) Assignee: National Steel Car Limited, Hamilton, Ontario (CA)

( * ) Notice: Subject to any disclaimer, the term of this patent is extended or adjusted under 35 U.S.C. 154(b) by 861 days.

(21) Appl. No.: 12/862,351

(22) Filed: Aug. 24, 2010

(65) Prior Publication Data

US 2010/0320167 A1 Dec. 23, 2010

Related U.S. Application Data

(63) Continuation of application No. 11/321,056, filed on Dec. 30, 2005, now Pat. No. 7,780,021.

(51) Int. Cl.
*B61G 9/00* (2006.01)
*B61G 9/24* (2006.01)

(52) U.S. Cl.
CPC ..... *B61G 9/24* (2013.01)

(58) Field of Classification Search
USPC ..... 213/50, 51, 56, 58, 60, 61, 69
See application file for complete search history.

(56) References Cited

U.S. PATENT DOCUMENTS

| | | | | |
|---|---|---|---|---|
| 1,551,353 | A * | 8/1925 | Weston | 213/56 |
| 3,836,013 | A * | 9/1974 | Hawthorne | 213/54 |
| 3,876,081 | A * | 4/1975 | Metzger | 213/69 |
| 4,573,594 | A * | 3/1986 | Kunst et al. | 213/51 |
| 5,115,926 | A * | 5/1992 | Kaufhold | 213/50 |
| 5,312,007 | A * | 5/1994 | Kaufhold et al. | 213/75 R |
| 5,360,124 | A * | 11/1994 | Wurzer et al. | 213/62 R |
| 5,547,089 | A * | 8/1996 | Daugherty, Jr. et al. | 213/62 R |
| 5,571,257 | A * | 11/1996 | Bruski et al. | 213/50 |
| 5,931,101 | A * | 8/1999 | Kaufhold et al. | 105/420 |
| 6,305,298 | B1 * | 10/2001 | Kaufhold et al. | 105/420 |
| 6,390,313 | B1 * | 5/2002 | Ring et al. | 213/62 R |
| 7,410,069 | B2 * | 8/2008 | Hogbring et al. | 213/50 |
| 7,780,021 | B2 | 8/2010 | Forbes | |
| 2007/0007225 | A1 * | 1/2007 | Meyer et al. | 213/50 |
| 2007/0151941 | A1 * | 7/2007 | Forbes | 213/75 R |
| 2010/0320167 | A1 * | 12/2010 | Forbes | 213/51 |

OTHER PUBLICATIONS

Association of American Railroads; Mechanical Division, Manual of Standards and Recommended Practices; Standard S-236-78.
Association of American Railroads; Mechanical Division, Manual of Standards and Recommended Practices; Standard S-250-91.
Association of American Railroads; Mechanical Division, Manual of Standards and Recommended Practices; Standard S-239-92.
Association of American Railroads; Mechanical Division, Manual of Standards and Recommended Practices; Standard S-2017-91.

* cited by examiner

*Primary Examiner* — Jason C Smith
(74) *Attorney, Agent, or Firm* — Hahn Loeser & Parks, LLP

(57) ABSTRACT

A rail road car has draft sills, and draft gear mounted in the draft sills, by which loads are passed along the train line of cars. The draft gear is mounted to the drafts sill webs between front and rear draft stops. The front and rear draft stops have portions that protrude beyond the plane of the inner face of the draft sill webs. The rear draft stops have a boss that extends past the plane of the inside face of the draft sill web, such that the peripheral weld about the boss may tend to be placed in stress in the plane of the web.

29 Claims, 22 Drawing Sheets

RAIL ROAD CAR DRAFT FITTINGS

This application claims the benefit under 35 USC 120 of the priority of U.S. patent application Ser. No. 11/321,056 filed Dec. 30, 2005, of which this case is a division, the specification and drawings thereof being incorporated herein by reference.

FIELD OF THE INVENTION

This invention relates to the field of rail road freight cars.

BACKGROUND

This description discusses draft components for railroad cars, and in particular, draft stops and their relationship to the draft sills in which they may be mounted. The discussion is made and the terminology herein is used, in the context of freight car construction and operation in North America, and, most typically, in interchange service, and in compliance with standards of construction established by the Association of American Railroads (AAR).

By their nature, railroad cars tend to be releasably linked together end-to-end in a string drawn (or pushed) by one or more locomotives. The parts of a railway car that link one car to another and permit the longitudinal loads of the train to be passed from one car to the next define the draft equipment of the railroad car. Typically, a rail road car has a body that has a center sill, whether a stub center sill or a straight-through center sill. The portion of the center sill that lies longitudinally outboard of the truck center (or last truck center, in an articulated car) may be referred to as a draft sill. The draft sill is usually a hollow column, or beam, that lies beneath a deck or shear plate of the railroad car. It usually has two parallel lengthwise extending vertical webs. A coupler, draft gear, and draft gear stops are usually mounted within the draft sill. The draft gear, as it is called, may be a sliding sill, a hydraulic end-of-car-cushioning unit (EOCC), a standard draft gear or a short travel "MiniBuff" gear. One type of draft gear may weigh about 1100 lbs, and may have, for example, about 3 inches of travel at 500,000 lbs load. The coupler is mounted to push and pull upon the draft gear. The draft gear is retained by the draft stops. The draft stops are typically mounted to the inside of the draft sill webs, and provide a means by which the force on the draft gear (received through the coupler) can be carried along the car.

There are front draft stops and rear draft stops. The front and rear draft stops are spaced apart a longitudinal distance along the draft sill corresponding to the length of the draft gear employed in the car. Rear draft stops are located within the center sill or draft sill, longitudinally inboard of the front draft stops, typically immediately outboard of the centerplate casting. Rear draft stops receive longitudinal loads from the draft gear when the coupler shank is in longitudinal compression, such as in a "run-in" condition on a descent or during humping. Rear draft stops transmit these loads into the draft sill, and most typically into the draft sill webs. The front draft stops are located further outboard toward the striker at the distal end of the draft sill whence the coupler extends. Front draft stops receive loads from the other end of the draft gear when the coupler is run out, and the coupler shank is in tension and draws on the draft gear yoke. The front draft stops transmit these loads into the draft sill, most typically into the draft sill webs. A striker, or "the striker" is the part of the car that forms the end face fitting of the draft sill. According to *Railway Age's Comprehensive Railroad Dictionary*, (Simmons-Boardman, Omaha, 1984) the striker is designed to be the first point of contact in the event the coupler is driven back far enough to strike the car body. The striker's function is to absorb the resulting impact and prevent damage to the center sill and surrounding area. The inventor believes that the foregoing definitions of front draft stop, rear draft stop, and striker are the customary and ordinary meanings of these terms as understood by persons skilled in the art.

This document also discusses weld fillets. The term "fillet" may be used in either of two contexts. In the first context, the "fillet" may be the empty groove, or linear notch, or angle, into which a passes, or several passes, of weld metal may be laid down. In the second sense, the term "fillet" may refer to the resulting fillet weld, or the weldmetal of that fillet weld, after the weld has been made. Although successive fillets may be laid down repeatedly to form a plug weld, the resulting accumulation of welding passes in a plug weld is usually referred to as a plug weld. Similarly, the resulting weld between two abutting plates is usually referred to as a butt weld, rather than as a fillet weld, notwithstanding that the weld may have been made by welding passes on one or both sides of the plate that were laid down as fillets.

So that the invention herein may better be understood the Applicant has included illustrations of a prior art draft gear assembly, those Figures being labeled 2*a*-2*h*. In one known assembly, the striker 58 and the front draft stops 80, 82 are formed of a single integral casting.

An example of existing rear draft stop design is shown in FIGS. 2*a*, 2*b*, 2*g* and 2*h*. The existing rear draft stop 90, 92 may tend to have a leg, or face 94, that is substantially planar, and that may tend to lie in planar abutment against the inside planar face of the side sill web 53. Web 53 has a series of parallel slots 57. The connection between web 53 and face 94 is made by clamping rear draft stop 90 or 92 in place and filling the three large, longitudinally running slots 57 with plug welds. In use, the longitudinal loads imposed on the rear draft stops are transferred through the weldmetal in shear, and into the side sill webs.

An example of an existing key slot design is shown in FIGS. 2*c*, 2*i* and 2*j*. In these illustrations, the monolithic combination striker and front draft stop casting, 100, includes a striker portion, identified as striker 58, and integrally formed front draft stop portions, identified as front draft stops 80, 82. The walls 85, 87 of the front draft stop that define the upper and lower boundaries of the key slot are (a) of comparable thickness to the thickness of the side sill webs, and are formed with a sharp internal corner as at 83.

In some cars there has been a tendency toward cracking of the draft sill webs at the draft stop fittings. This suggests to the inventor that attention to fatigue details and load paths in the draft stop assembly, and in the draft sill in general, may be helpful.

SUMMARY OF THE INVENTION

In an aspect of the invention, there is a draft assembly for a rail road freight car. It includes a draft sill having a draft pocket defined therewithin in which draft gear may be mounted. The draft sill has a pair of spaced apart draft sill walls. There are front and rear draft stops for mounting to the draft sill walls. At least a first of the draft sill walls has a face oriented inwardly relative to the draft pocket. The first draft sill wall has an accommodation formed therein. One of the draft stops is a first draft stop. The first draft stop has a first interface defining a seat against which draft gear mounted in the draft pocket may work. The first draft stop has a second interface co-operably engageable with the first draft sill wall. The second interface includes a first portion for seating against the inwardly oriented face of the first draft sill wall. The second interface includes a second portion seatable within the accommodation formed in the first draft sill wall. In operation, the first draft stop is operable to receive loads from draft gear at the first interface member, and operable to transmit loads between the second interface to the first draft sill wall.

In a further feature of that aspect of the invention, the accommodation includes an aperture formed through the first draft sill wall. In another feature, the second portion of the second interface stands proud of the first portion of the second interface. In an additional feature, the second portion of the second interface stands proud of the first portion of the second interface. In still another feature, the accommodation includes an aperture formed in the first side sill wall, the aperture has a profile, and the second portion of the second interface of the first draft stop has a footprint of a shape corresponding to the profile of the aperture.

In yet another feature, the accommodation has a narrowing profile, and the second portion of the second interface has a corresponding narrowing profile. In a further feature, the accommodation narrows from a broader end to a narrower end, the second portion of the second interface narrows from a broader end to a narrower end, and the narrower end of the second portion of the second interface is more distant from the first interface of the first draft stop than is the broader end of the second portion of the second interface of the first draft stop.

In still another feature, the first draft stop is welded to the draft sill wall with the second portion of the second interface of the first draft stop seated in the accommodation. In another feature, the second portion of the second interface has a periphery, and the second portion of the second interface is welded into the accommodation about the periphery. In another feature, the accommodation includes an aperture formed through the first draft sill wall, the second portion of the second interface includes a protrusion seated within the aperture, the protrusion having a periphery, and the protrusion being welded within the aperture about the periphery. In a still further feature, the draft sill wall has a through thickness. The second portion of the second interface of the draft stop stands proud of the first portion of the second interface of the draft stop a distance corresponding substantially to the through thickness of the draft sill wall.

In yet another feature, the draft sill wall has a first margin for cooperation with a draft sill upper flange, and a second margin distant therefrom, the accommodation is a rebate formed through the draft sill wall, the rebate has an entrance formed in the second margin, and the draft stop can be introduced into the accommodation through the entrance at the second margin. In another feature, the accommodation is an aperture having a closed periphery. In still another feature, the accommodation includes an aperture having a closed periphery and the second portion of the second interface member is a boss having a shape formed to fit within the periphery.

In another aspect of the invention there is a rear draft stop for a rail road freight car. The draft stop has first and second structurally interconnected interfaces. The first interface is operable to receive draft loads, and the second interface is operable to transmit loads to a draft sill. The second interface has first and second draft sill web engagement portions, the first portion being locatable against a face of a draft sill wall, and the second portion standing proud of the first portion.

In a feature of that aspect of the invention, the first portion includes a substantially planar surface for abutment against a draft sill wall. In another feature, the second portion of the second interface includes a boss standing proud of the substantially planar surface. In a further feature, the first portion of the second interface has a footprint. A closed peripheral boundary is defined by a line of shortest length enclosing the footprint, and, when viewed perpendicular to a normal projection of the footprint the second portion has a centroid; and the centroid lies within the closed peripheral boundary. In another feature, the first portion of the second interface includes three contact points lying in a plane and the second portion of the interface includes a protrusion standing proud of the plane. In an alternate feature, the first portion of the second interface has a footprint for seating against a draft sill wall, and, when viewed normal to the footprint the second portion has a centroid, the footprint being free of any gap therein subtending any arc greater than 150 as measured from an angular origin located at the centroid. In another feature, the footprint includes at least two pad portions. In another feature, the footprint includes at least three pad portions. In another feature, the footprint of the first portion extends continuously about the second portion of the second interface. In yet another feature, the first portion of the second interface defines a shoulder and the second portion defines a boss standing outwardly of the shoulder. In still another feature, the first portion of the second interface defines a continuous planar peripheral land for planar abutment against an inwardly facing surface of a wall of a draft sill, and the second portion of the second interface includes at least one boss extending proud of the planar abutment surface.

In another feature, when seen looking toward the second interface in a direction normal to the first portion of the second interface, the second portion of the second interface has a narrowing profile. In a further feature, the second portion of the second interface narrows from a broader part to a narrower part, and the narrower part of the second portion of the second interface is more distant from the first interface of the first draft stop than is the broader part of the second portion of the second interface. In a still further feature, the second portion of the second interface is chamfered to form a fillet into which passes of weldmetal can be introduced. In yet another feature, the second portion of the second interface is a boss standing proud of the first portion of the second interface, the first portion of the second interface extends in a plane, and the boss has an end face substantially parallel to the plane of the first portion of the interface. In another feature, the second portion of the second interface is a boss, the first portion of the second interface defines a peripheral land extending about the boss and defining a shoulder.

In still another aspect of the invention, there is a method of fabricating a draft sill assembly, the draft sill assembly including at least one draft sill wall defining one wall of a draft pocket, and at least one draft stop, the draft stop being free of an end striker portion. The method includes the steps of: forming an accommodation in the draft sill wall, the accommodation being exposed on an inwardly facing first side of the draft sill wall facing toward the draft sill pocket; providing the draft stop with a first portion for seating in the accommodation, and a second portion for mating engagement with the side of the draft sill facing toward the draft sill pocket, and in which the first portion stands proud of the second portion; placing the first portion in the accommodation and seating the second portion against the first side of the draft sill wall adjacent the accommodation; and securing the draft stop in place.

In a feature of that aspect of the invention, the method includes welding the draft stop in place. In another feature, the step of forming an accommodation includes the step of forming an aperture fully through the draft sill wall. In a further feature, the step of forming an accommodation includes the step of chamfering the accommodation to facilitate the laying down of a fillet of weld metal between the draft sill and the second interface of the draft stop. In still another feature, the step of providing the draft stop includes the step of providing includes the step of chamfering the first portion to facilitate the laying down of a fillet of weld metal between the second interface and the draft sill wall. In yet another feature, the step of forming an accommodation includes the step of forming an accommodation having a wider portion and a narrower portion. In a still further feature, the step of providing includes the step of forming the first portion to have a profile, when viewed in a direction normal to the second portion, that has a wide part and a narrow part. In a still yet further feature, the step of forming includes forming the wide part closer to the first interface than the narrow part.

In another feature, the step of providing includes the step of forming the first portion of the second interface to have a first profile; and the step of forming the accommodation includes the step of forming an aperture through the wall of the draft sill, the aperture having a second profile corresponding to, and being co-operably engageable with, the first profile. In a still further feature, the step of forming the first portion includes the step of shaping the first profile to have a wider part and a narrower part. In still another feature, the step of shaping includes the step of forming the wider part closer to the second interface than the narrower part. In yet another further feature, the method includes the step of forming a chamfer on at least one of (a) the aperture; and (b) the first portion of the second interface, and the step of securing includes the step of laying down a weld metal pass in the chamfer. In a further feature, the wall of the draft sill has a side facing the draft stop and a side facing away from the draft stop, and the step of securing includes the step of forming weldmetal fillets between the first portion and the draft sill wall from the side of the wall facing away from the draft stop. In another feature, the method includes the step of securing the draft stop to the wall of the draft sill before the wall of the draft sill is secured to the body of a rail road car. In yet another feature, the method includes the step of securing the draft stop to the wall before the wall is secured to any other wall of the draft sill.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1:
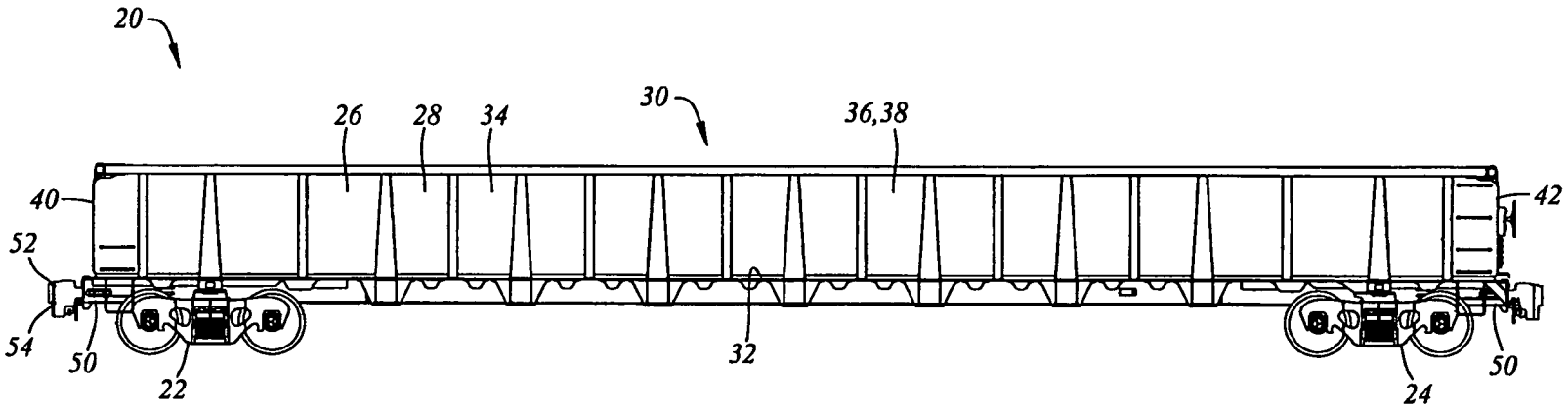
FIG. 1 is a general arrangement view of a railroad freight car.

The description that follows, and the embodiments described therein, are provided by way of illustration of an example, or examples, of particular embodiments of the principles or aspects of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for the rail road car described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of the centerplate. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts.

FIG. 1 shows a side view of an example of a rail road freight car 20 that is intended to be generically representative of a wide range of rail road cars in which the present invention may be incorporated. While car 20 may be suitable for a variety of general purpose uses, it may in one embodiment be a gondola car such as may be used for the carriage of bulk commodities. Car 20 may be symmetrical about both its longitudinal and transverse, or lateral, centerline axes. Consequently, it will be understood that the car has first and second, left and right hand side beams, bolsters and so on.

Car 20 has a pair of first and second trucks 22, 24, and a rail car body 26 that is carried upon, and supported by, trucks 22, 24 for rolling motion along rail car tracks in the manner of rail road cars generally. Rail car body 26 may include a wall structure 28 defining a lading containment receptacle 30. Wall structure 28 may include a base wall, which may be in the nature of a floor or flooring 32, and a generally upstanding peripheral wall 34 which may include a pair of first and second side walls 36, 38, and end walls 40, 42. Flooring 32, sidewalls 36, 38 and end walls 40, 42 may tend to define an open topped box, namely receptacle 30, into which lading may be introduced. Generally speaking, car 20 may be of all steel, or predominantly steel construction, although in some embodiments other materials such as aluminum or engineered polymers or composites may be used for some or a predominant portion of the containment receptacle structure.

Rail car body 26 may include draft sills 50 mounted at either end thereof. Draft sills 50 may be extensions of a straight-through center sill running the full length of car 20, or they may be portions of stub sills that do not run the full length of the car, stub sills being found, for example, in such types of cars as center flow rail road cars such as plastic pellet feedstock cars, tank cars, and grain or potash gondola cars.

Figure 2A:
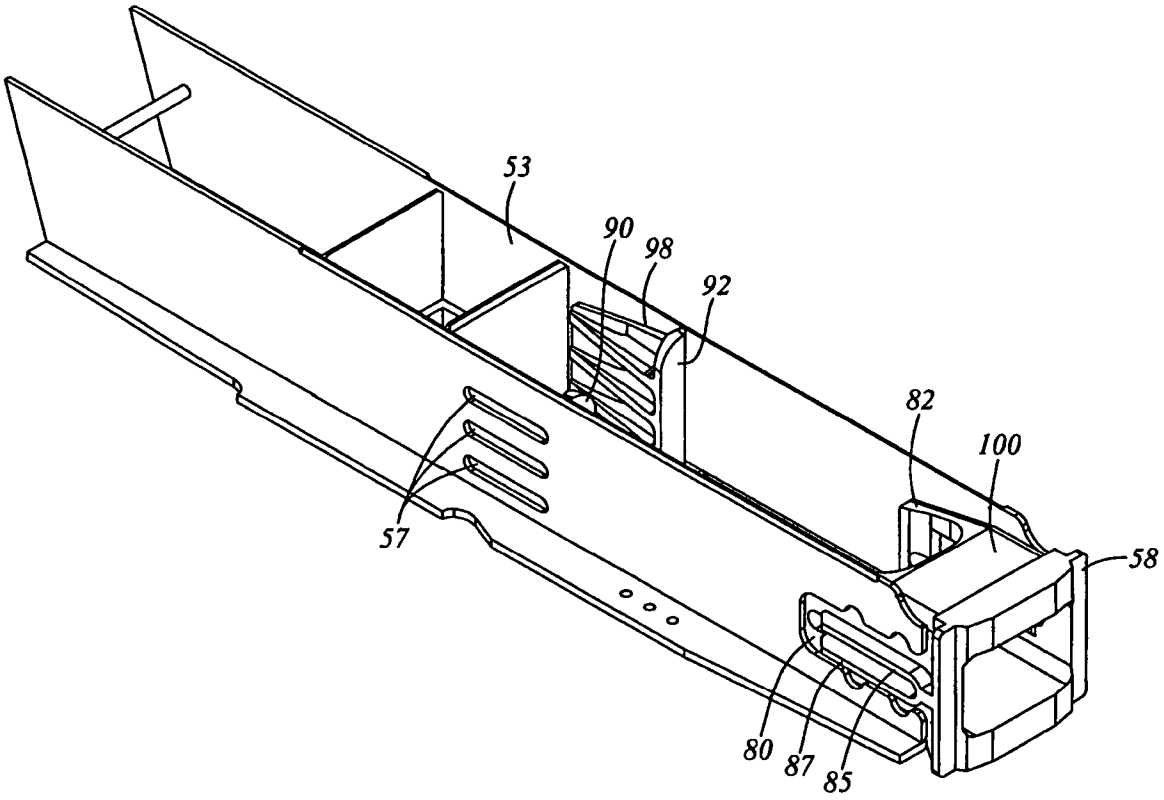
Figure 2a (Prior Art)
FIG. 2*a* shows an isometric view of a prior art draft assembly for the freight car of FIG. 1 with the center sill top flange, or cover plate removed.
Figure 2B:
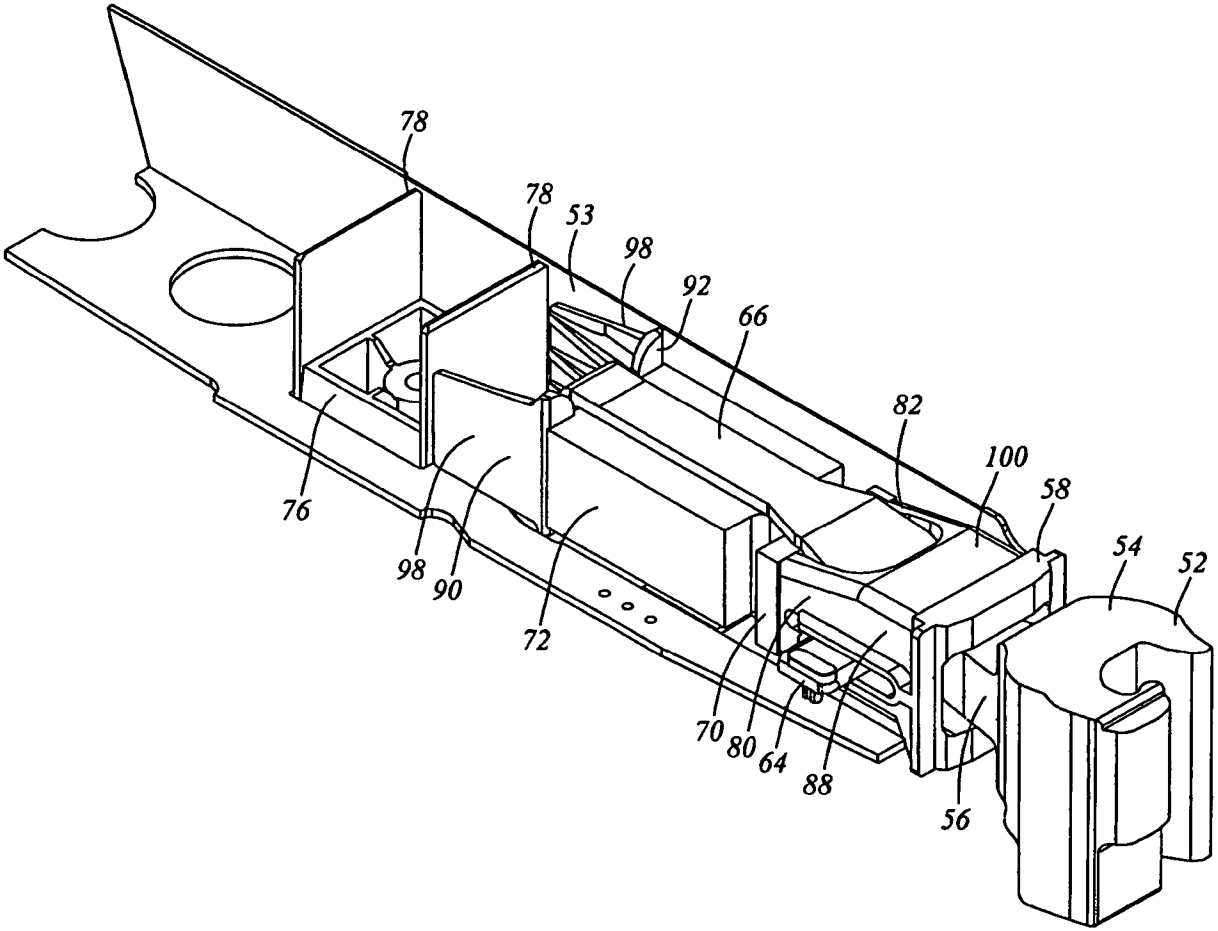
Figure 2b (Prior Art)
FIG. 2*b* shows the assembly of FIG. 2*a* with the near side draft sill web removed to permit the internal components of the draft assembly more easily to be seen.
Figure 2C:
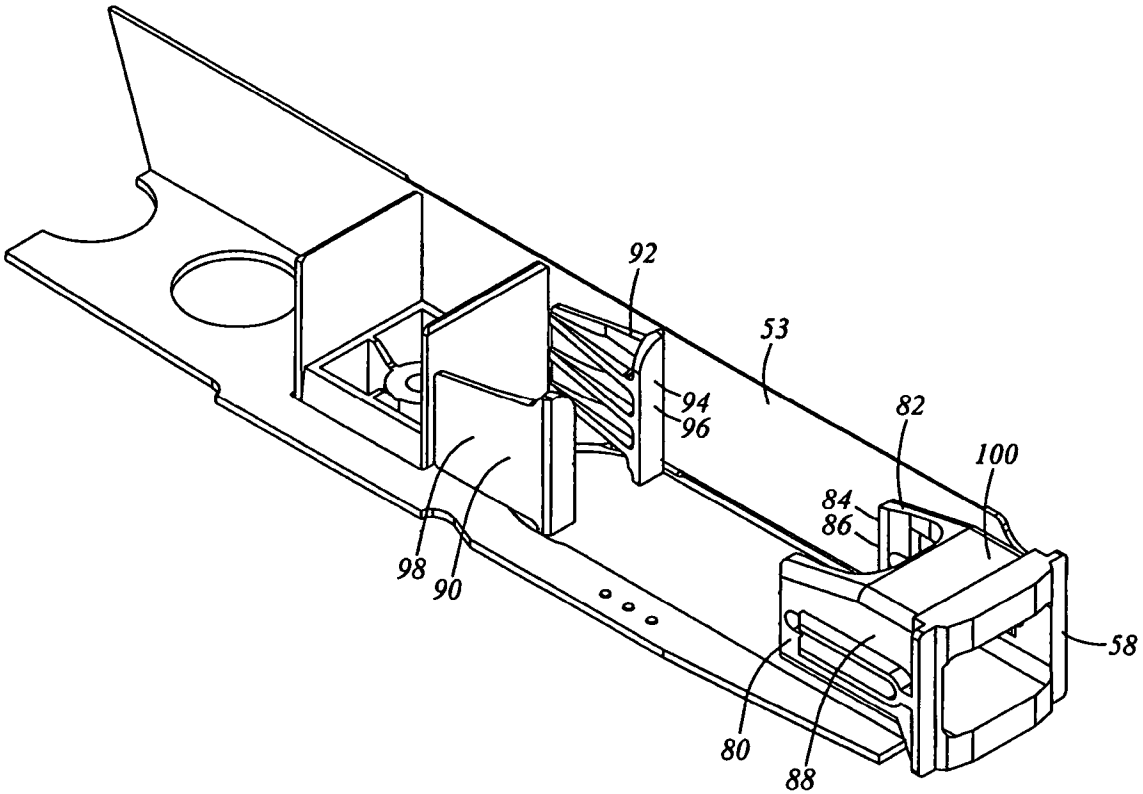
Figure 2c (Prior Art)
FIG. 2*c* shows the assembly of FIG. 2*b* with the draft gear, yoke, follower, coupler and pin removed.
Figure 2D:
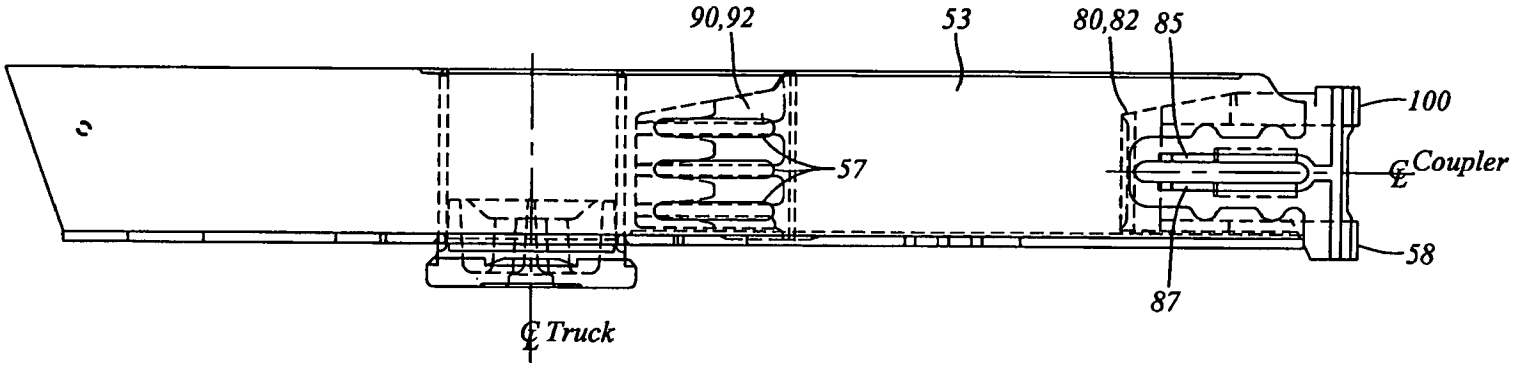
Figure 2d (Prior Art)
FIG. 2*d* shows a side view of the draft assembly of FIG. 2*a;*
Figure 2E:
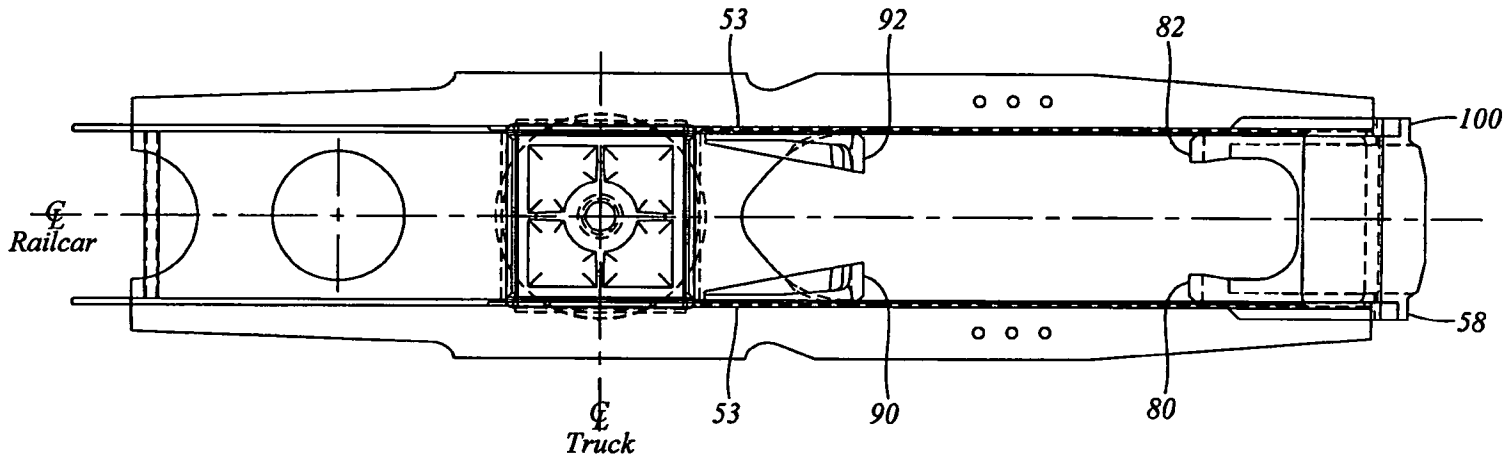
Figure 2e (Prior Art)
FIG. 2*e* shows a top view of the draft assembly of FIG. 2*a;*
Figure 2F:
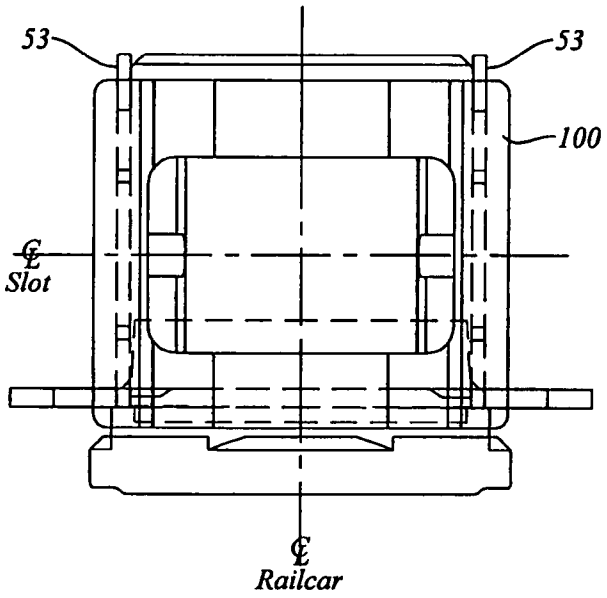
Figure 2f (Prior Art)
FIG. 2*f* shows an end view of the assembly of FIG. 2*a* looking from the striker toward the centerplate.
Figure 2H:
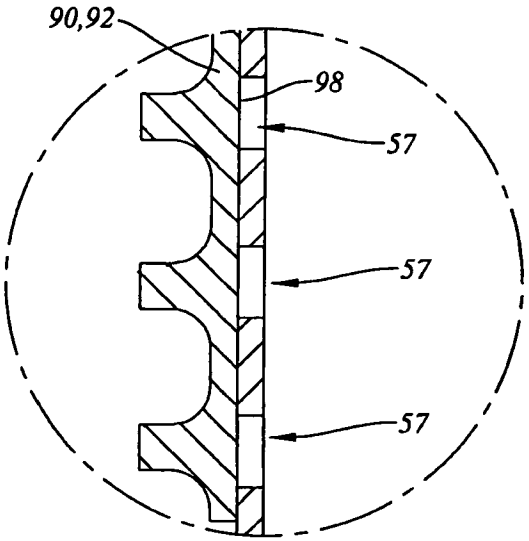
Figure 2h (Prior Art)
FIG. 2*h* shows an enlarged detail of the section of FIG. 2*g;*
Figure 2G:
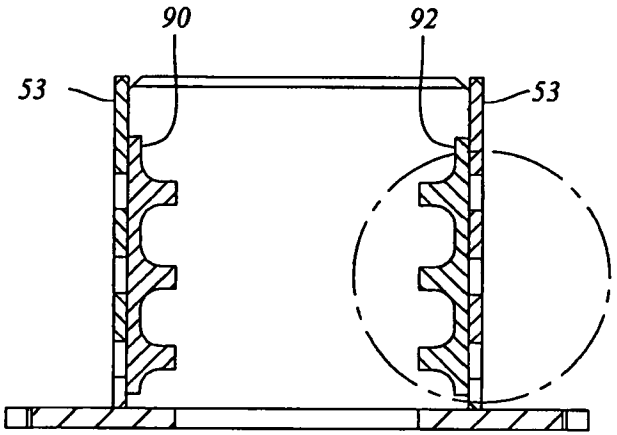
Figure 2g (Prior Art)
FIG. 2*g* shows a section through the rear draft stop and draft sill web of the assembly of FIG. 2*a;*
Figure 2J:
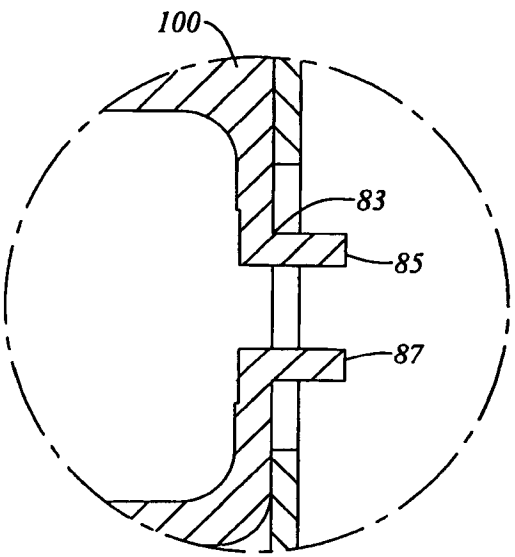
Figure 2j (Prior Art)
FIG. 2*j* shows an enlarged detail of the section of FIG. 2*i;*
Figure 2I:
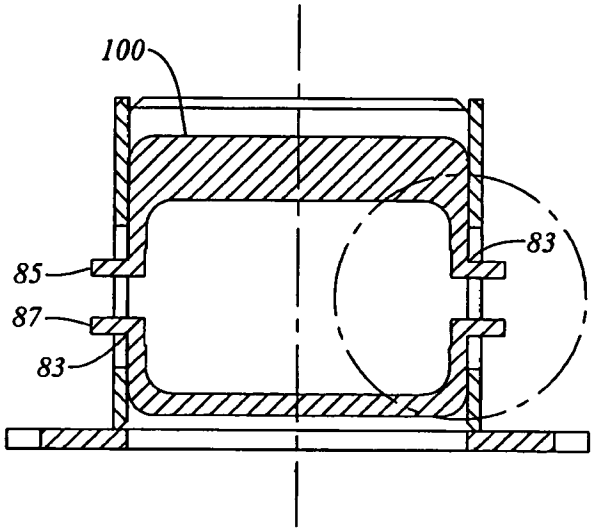
Figure 2i (Prior Art)
FIG. 2*i* shows a section through the striker slot of the assembly of FIG. 2*a;*

Most typically, a draft sill, or the draft sill portion of a center sill more generally, extends longitudinally outboard from the location of a centerplate at the truck center, to the draft pocket, and terminates at a bellmouth, or striker. Although different types of coupler shank may involve a wider or narrower bell mouth, and may involve a shorter or longer distance from the striker to the draft gear, the arrangement shown in FIGS. 2*a*, 2*b* and 2*c* is intended to be generic to the extent that it shows a coupler 52 having a longitudinally outwardly located knuckle, or horn, 54, and a longitudinally inwardly extending shank 56. Whereas the series of FIGS. 2*a*-2*j* may tend to show an example of an existing arrangement, the series of FIGS. 3*a*-3*l*, show a generally corresponding arrangement employing aspects and features of the present invention. Shank 56 extends longitudinally inboard within a bell mouth, or striker or striker assembly 58, that is mounted to the longitudinally outboard end of draft sill 50. Shank 56 has a butt end 60, having a slot 62 formed therein. A cross pin, or key, 64 extends through slot 62. The ends of pin 64 engage the opposed eyes of a yoke 66. The yoke has an internal opening 68. A draft gear follower 70 seats against butt end 60. A draft gear 72 is captured between follower 70 and the cross member 74 of yoke 66. These elements are contained in draft sill 50 longitudinally outboard of centerplate fitting 76, whose center defines a truck center of the railroad car more generally. Fitting 76 may be boxed between the webs of the centersill and internal cross-webs 78 that extend between the center sill webs. Cross-webs 78 may be located in the plane of the webs of the main bolster, and may provide web continuity across the center sill.

Front draft gear stops 80, 82 (left and right hand) are mounted longitudinally outboard of the longitudinally outboard end of draft gear 72. Front draft gear stops 80, 82 have a first interface 84, which may be an abutment 86, against which the longitudinally outboard end of draft gear 72 may drive follower 70 forced when coupler shank 56 is in longitudinal tension, and the yoke is drawn outward, working against the rear, or longitudinally inboard end of draft gear 72. The front face of draft gear 72 works against the rear face of follower 70, and forces it against the rearward facing first interface 84. Under this loading condition, the force of compression of draft gear 72 is transmitted by way of follower 70 into front draft stops 80, 82 through first interface 84. Front draft gear stops 80, 82 also have a second interface 88, mated to one of the webs of draft sill 50, through which the load received at first interface 86 is transmitted into draft sill 50.

Rear draft stops 90, 92 (left and right hand) are mounted longitudinally inboard of the inboard end of draft gear 72, and outboard of center plate fitting 76. Rear draft stops 90, 92 each have a first interface 94, which may be an abutment 96, at which they receive loads from draft gear 72 when coupler 52 is place in longitudinal compression and butt end 60 of shank 56 drives follower 70 to push against the front end of draft gear 72, thereby compressing it. Rear draft stops 90, 92 also have a second interface 98 mated with the respective webs of draft sill 50 at which the force received that the first force transfer interface 94 is transmitted from rear draft stops 90, 92 into the webs of draft sill 50.

Front Draft Stop 80, 82

Front draft stop 80 is shown in FIGS. 4*a* to 4*f*. Front draft stop 82 is identical to front draft stop 80, but is of opposite hand. In that light, a description of front draft stop 80 will be understood also to be a description of front draft stop 82.

Front draft stop 80 may be a monolithic casting or forging, and may be formed separately of the striker casting or fabricated striker assembly 58. These castings (or forgings) may be made of iron based materials, such as steel. As noted front draft stop 80 may have the general form of an angle bracket 100, having a first leg 102, and a second leg 104, the first and second legs being oriented at right angles to each other. First leg 102 may tend, when installed, to stand inwardly proud of second leg 104, and may tend to present a surface 106 that is oriented to face away from second leg 104, and, in use, to face toward draft gear 72. Surface 106 may define the contact interface that is abutment 86, and through which loads from draft gear 72 are received by way of follower 70.

The loads carried by the draft stops, whether front or rear, may be very substantial, given that the rated load for the shank of coupler 52 may exceed 1 million pounds. Bracket 100 may also include reinforcements, or stiffeners 110, which may be webs 112 that support first leg 102, those stiffeners extending from the back side of leg 102 (i.e., away from draft stop 72) toward, and merging into second leg 104. Stiffeners 110 may be spaced apart along the back side of leg 102 to spread their support. Stiffeners 110 may have a generally triangular shape when viewed from above or below (when front draft stop 80, 82 is installed) with one side of the triangle merging into leg 102, another side merging into leg 104, and the third side defining the hypotenuse running between the other two sides. Stiffeners 110 may tend to be relatively thick and squat in terms of height from leg 104, such that bracket 100 may also be thought of as a monolith having a thickened or wider end 114 at which leg 102 is formed, and a narrower end region 116 distant therefrom. The thickened end 114 may have hollows, or depressions 118 formed therein with the walls that are left to either side of the depressions defining webs 112. First leg 102 may have a distal edge or margin 120, being the portion most distant from second leg 104, That margin may have a generally central easing, accommodation, or allowance, or gully or dip, identified as relief 122 such as may accommodate the butt end of the shank of the coupler. Relief 122 may be formed on a substantially circular radius.

Second leg 104 may have a generally triangular shape when seen in plan form. The base of this triangular shape is located at the junction with first leg 102, and the shape may then taper to an apex of the triangular form located distantly therefrom at region 116. The apex region may have a generous radius, as indicated at 124. Second leg 104 may include an opening formed therethrough, identified as slot 126. Slot 126 is a slot sized to accept key 64. Key 64 may be of a size specified by an AAR standard such as S-121, and may be about 6 inches wide by about 1½ inches thick. In one embodiment, slot 126 may be about 13 inches long by about 1⅝ inches wide. On the outside face 128 of second leg 104, there may be a raised peripheral margin 130 extending about the far end of slot 126 merging into the middle pair of stiffeners 110. Slot 126 may be rounded at both ends.

Second leg 104 may include an inside face 132, namely the face to be placed next to web 53 of draft sill 50, typically in planar opposition thereto. Amidst face 132 there may be a peripherally extending built up portion, or protruding portion, or boss, or wall 134, such as may tend to stand proud of face 132 and, when installed, may protrude laterally outboard through the associated accommodation 136 formed in web 53 of draft sill 50. Accommodation 136 may have generally the same profile as the outer periphery of wall 134, such that the one may fit inside, or be nested inside the other, as a male part in a female part, or inter-fitting positive and negative complementary images.

It may be that the edge of accommodation 136 may be chamfered, or, alternatively, the side of protruding wall 134 may be sloped, or chamfered, such that the outer flanks 140 of wall 134 slant outwardly and downwardly away and form one side of a generally v-shaped fillet identified generally as 135. Fillet 135 may have another side defined by the cut or exposed facing edge 142 of accommodation 136, and the base of the fillet may be defined by the bottom, which may be a radiused bottom, 144 at the foot of flanks 140. As may be noted, the through thickness $t_{134}$ of wall 134 may be substantially greater than web 53. The generally v-shaped fillet 135 may be filled with weld metal. This weldment may be formed by an automatic welding machine. A further weldment 137 may be formed around the outside periphery of second leg 104 more generally. To that end, the inside corner of leg 102 may be chamfered as at 148 to provide a weld fillet. The slope of flanks 140 may be in the range of 30 to 60 degrees, and in one embodiment may be about 45 degrees.

Figure 3B:
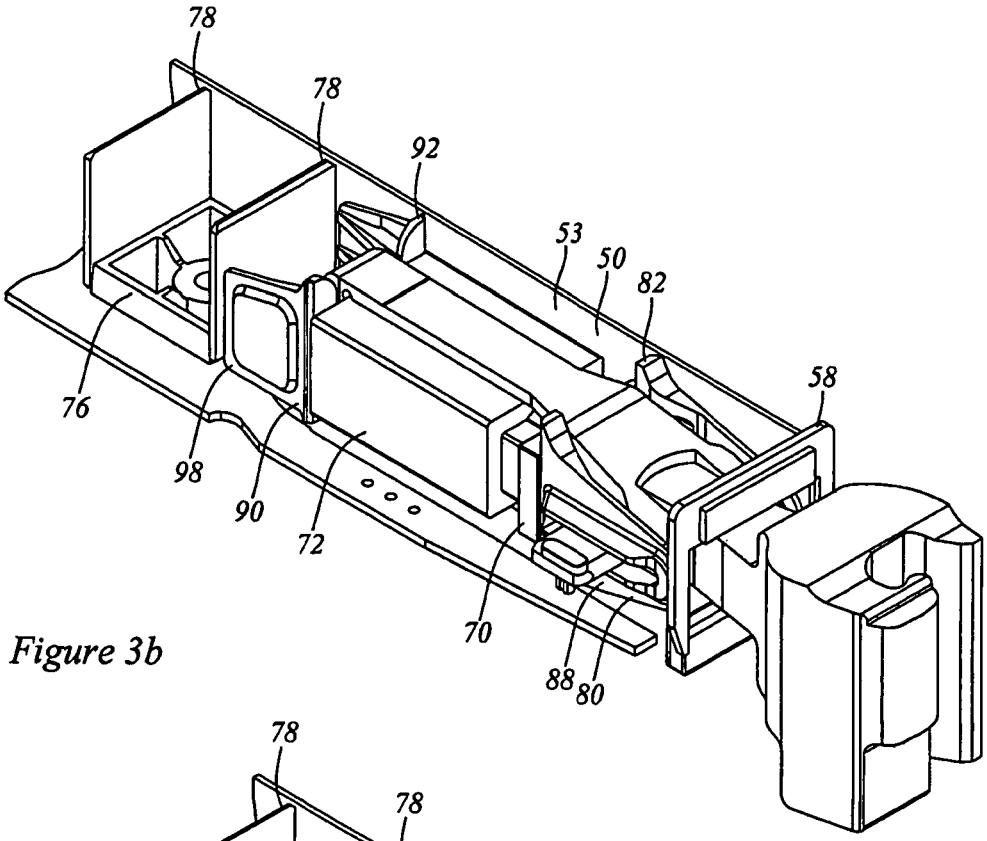
FIG. 3*b* shows the assembly of FIG. 3*a* with the top cover plate and near side draft sill web removed.
Figure 3A:
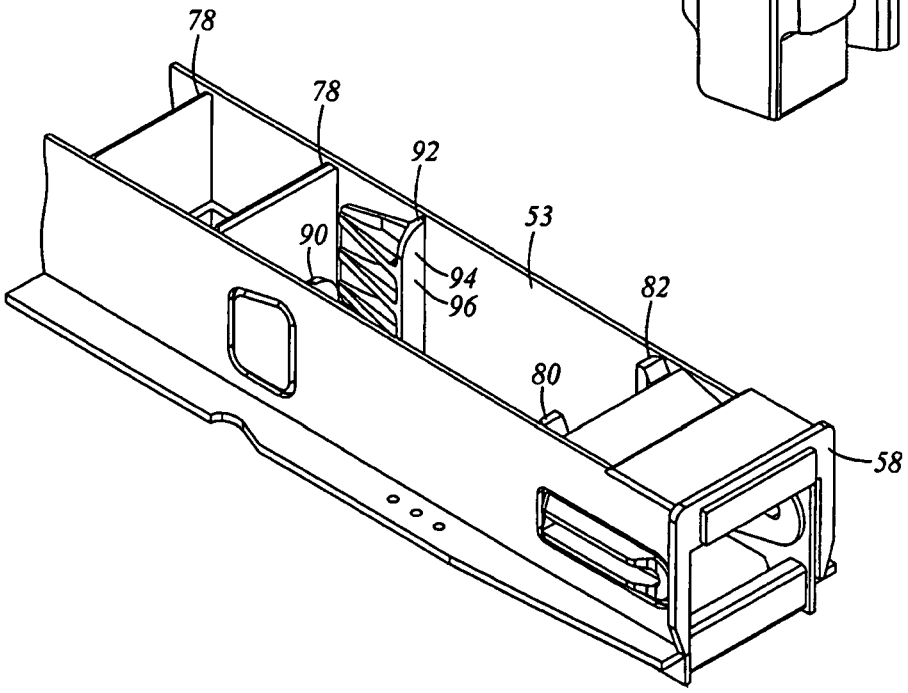
FIG. 3*a* shows an isometric view of a draft assembly for the railroad freight car of FIG. 1 with the center sill top flange, or cover plate, removed.
Figure 3C:
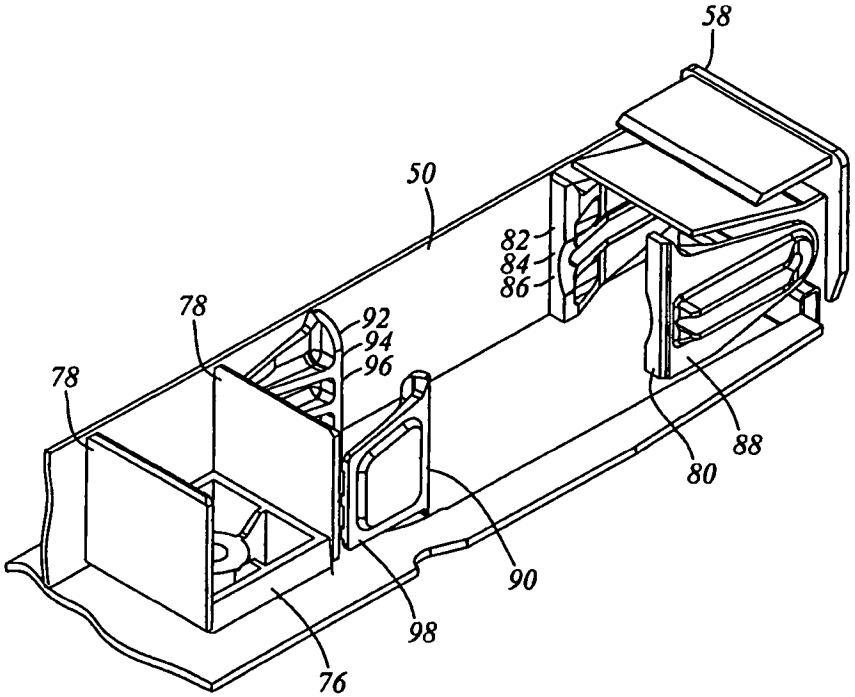
FIG. 3*c* shows the assembly of FIG. 3*a* with the near side web of the center sill removed with the near side draft sill web removed to permit the internal components of the draft assembly more easily to be seen.
Figure 3D:
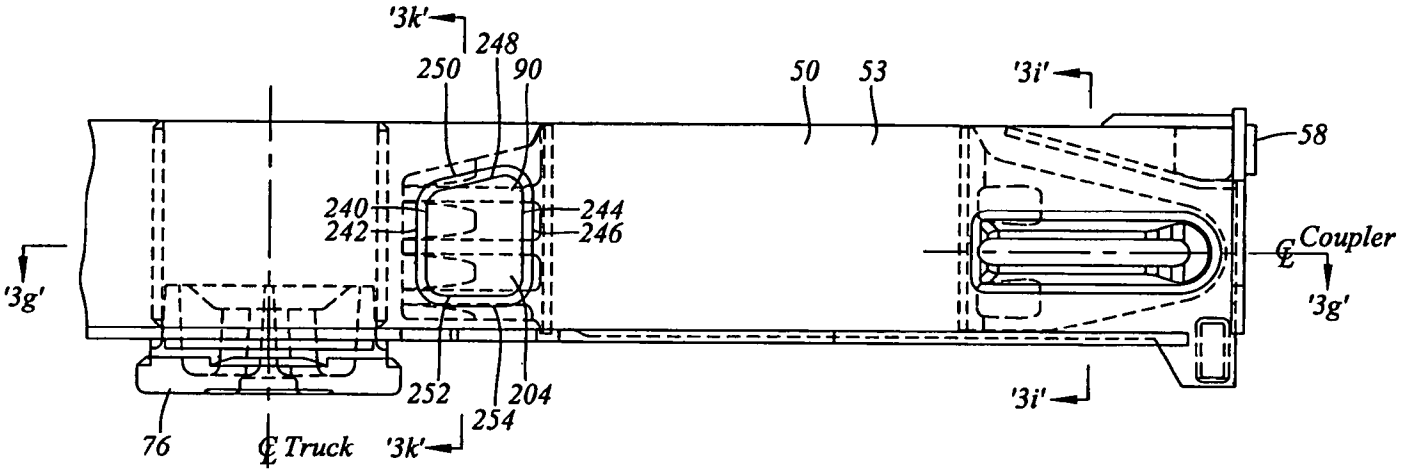
FIG. 3*d* shows a side view of the draft assembly of FIG. 3*a;*
Figure 3G:
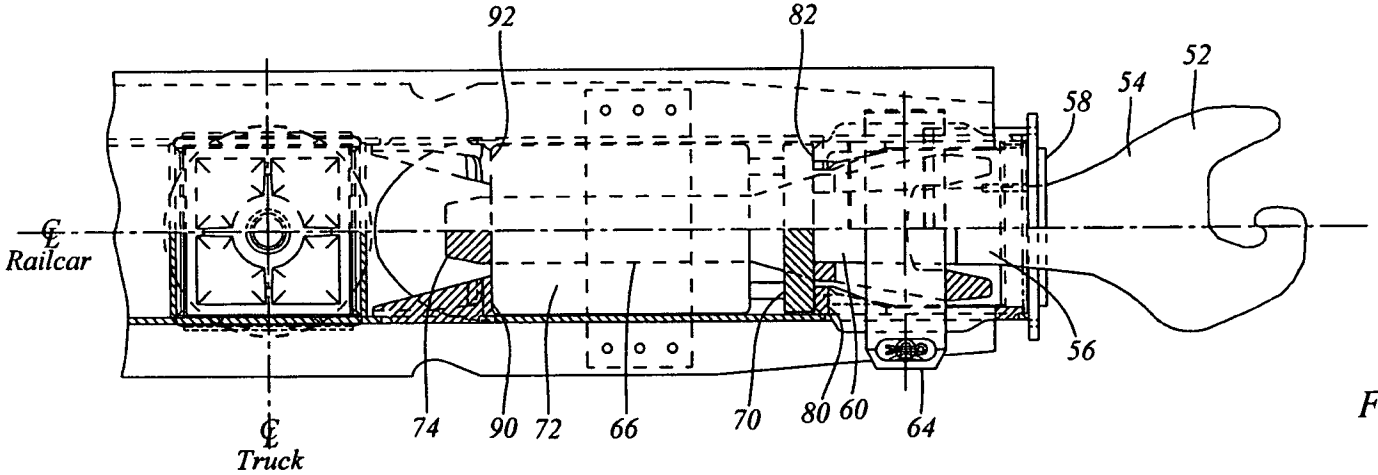
FIG. 3*g* shows a horizontal half section on '3*g*-3*g*' of FIG. 3*d;*
Figure 3E:
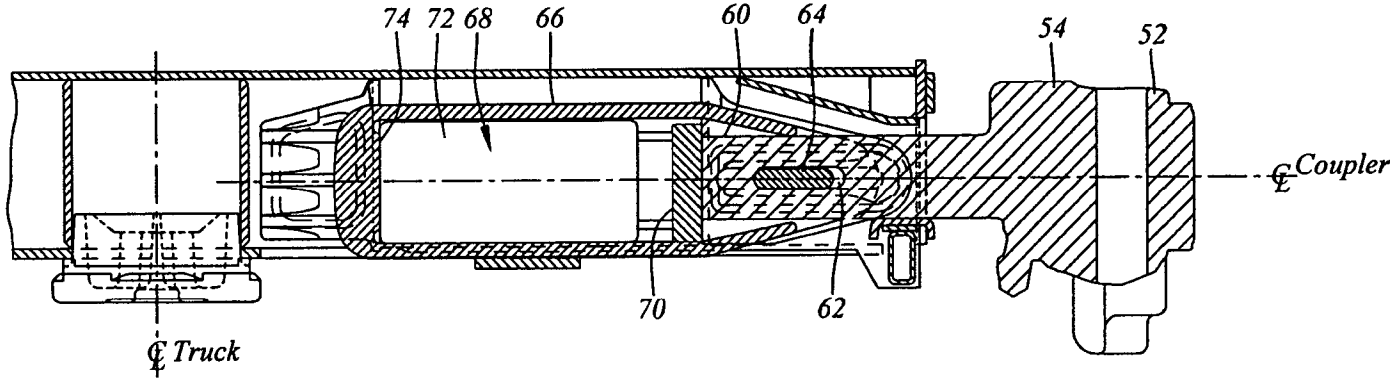
FIG. 3*e* shows a section on a vertical plane on the longitudinal centerline of the assembly of FIG. 3*b* viewed from the same direction as FIG. 3*d;*
Figure 3F:
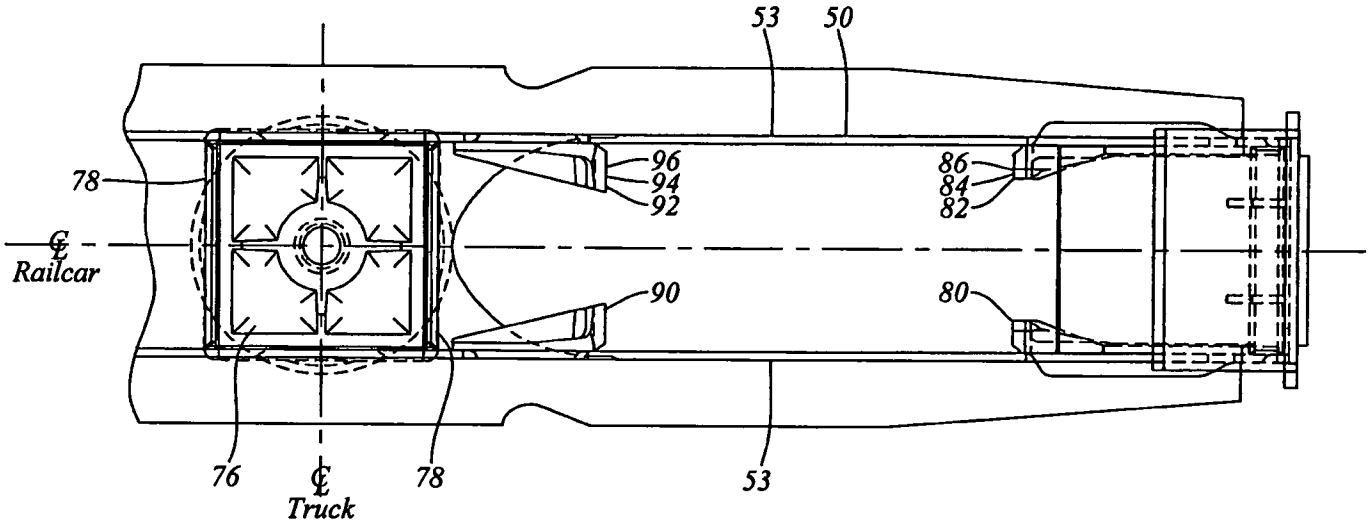
FIG. 3*f* shows a top view of the draft assembly of FIG. 3*a;*
Figure 3H:
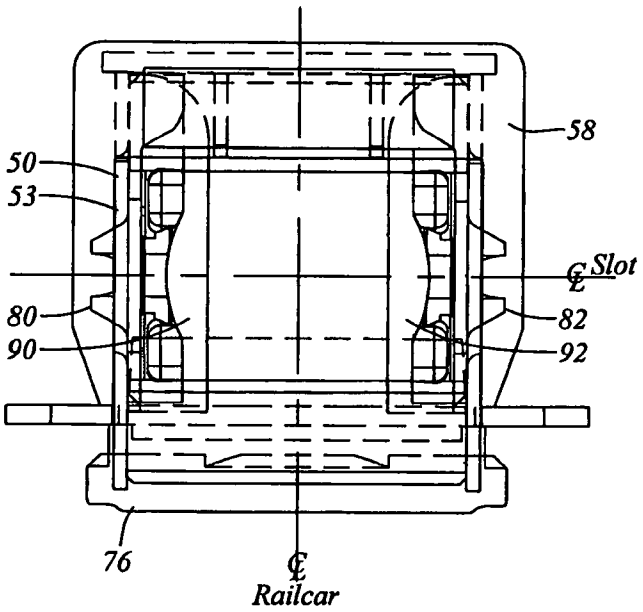
FIG. 3*h* shows an end view of the assembly of FIG. 3*a* looking from the striker toward the centerplate.
Figure 3J:
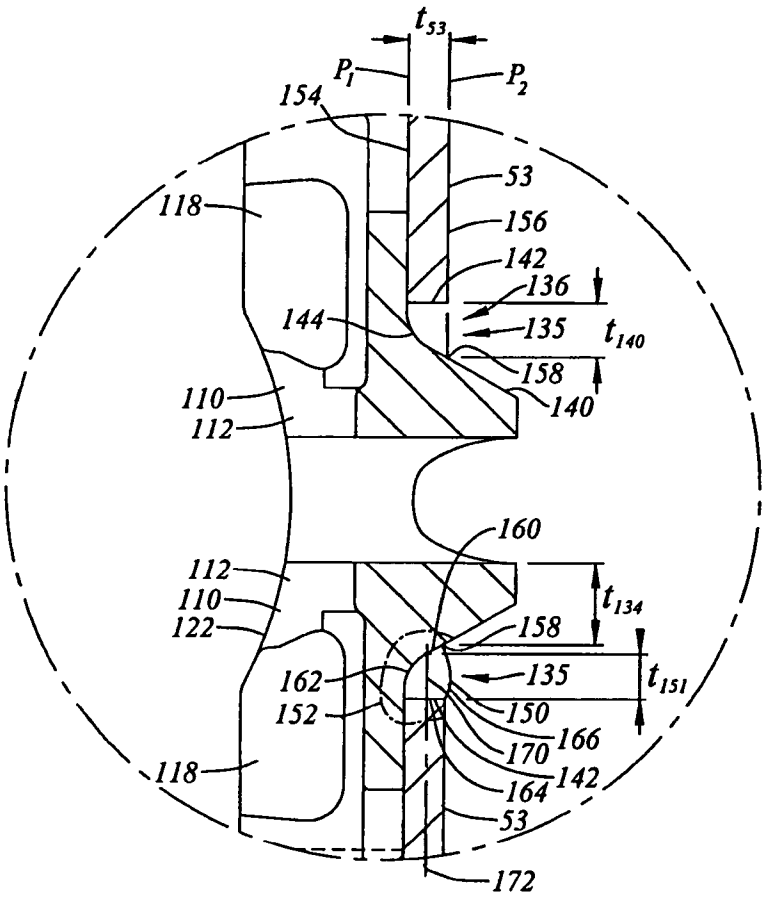
FIG. 3*j* shows an enlarge detail of the section of FIG. 3*i;*
Figure 3I:
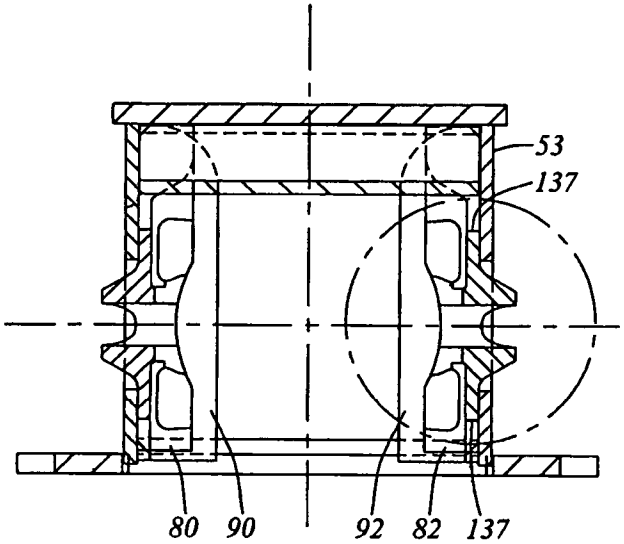
FIG. 3*i* shows a section through the front draft stop and draft sill web of the assembly of FIG. 3*a* as section 3*i*-3*i* of FIG. 3*d;*
Figure 3L:
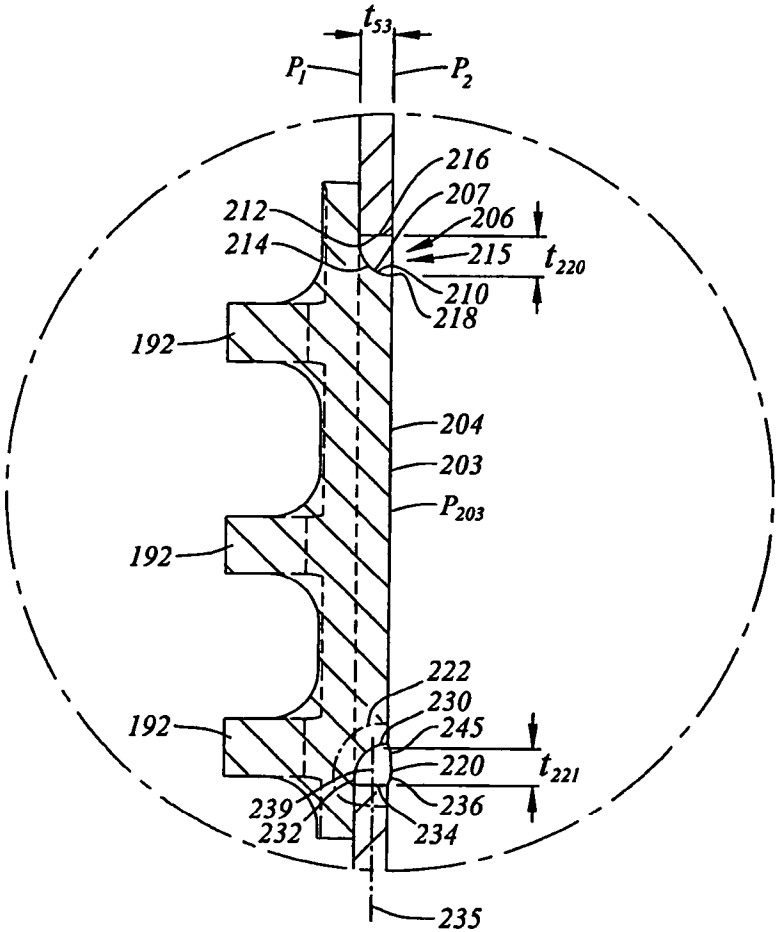
FIG. 3*l* shows an enlarged detail of the section of FIG. 3*k;*
Figure 3K:
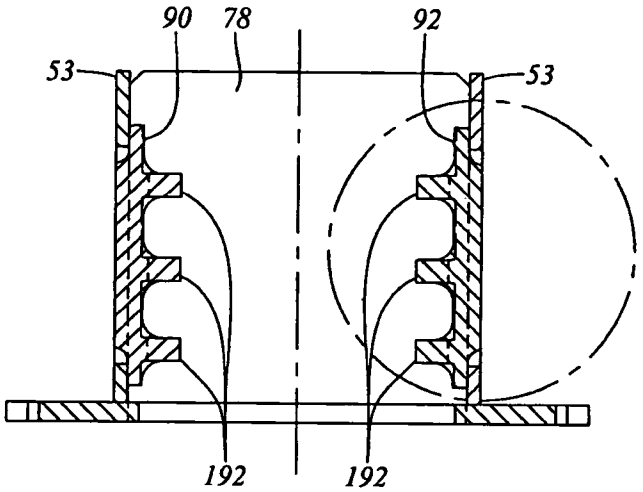
FIG. 3*k* shows a section of the assembly of FIG. 3*a* on '3*k*-3*k*' in FIG. 3*d;*
Figure 4A:
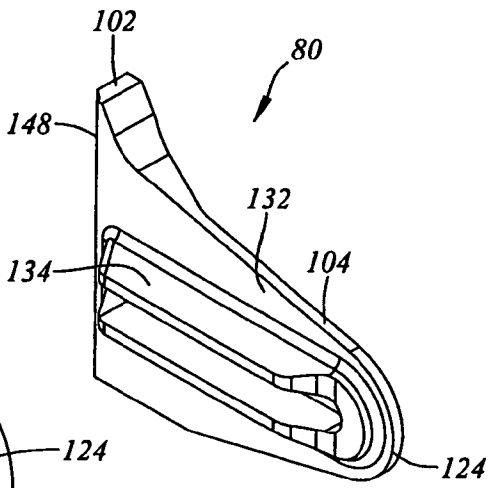
FIG. 4*a* shows an isometric view of a front draft stop of the assembly of FIG. 3*a;*
Figure 4D:
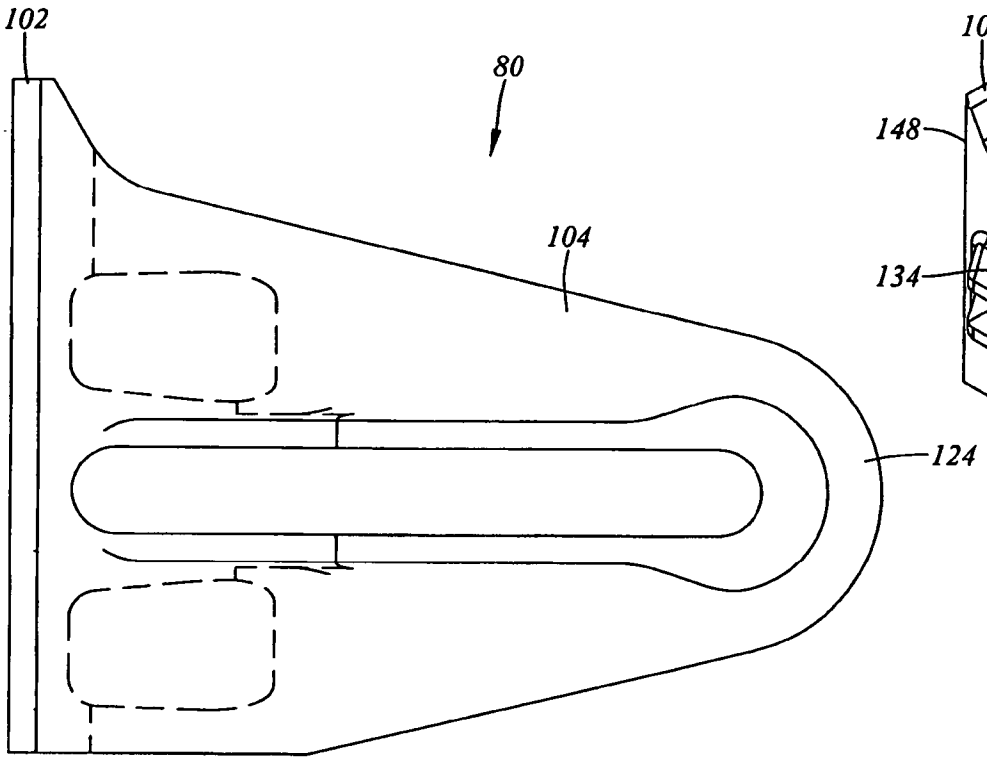
FIG. 4*d* is a plan view of the opposite side of the front draft stop of FIG. 4*c;*
Figure 4F:
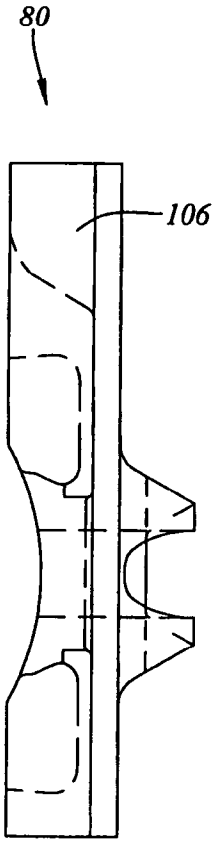
FIG. 4*f* is an opposite end view of the front draft stop of FIG. 4*e;*
Figure 4B:
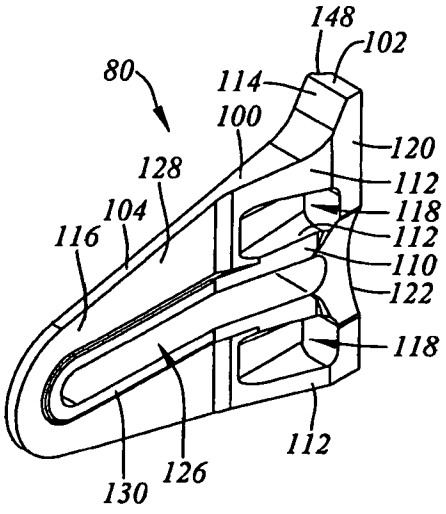
FIG. 4*b* is an isometric view of an opposite face of the front draft stop of FIG. 4*a;*
Figure 4C:
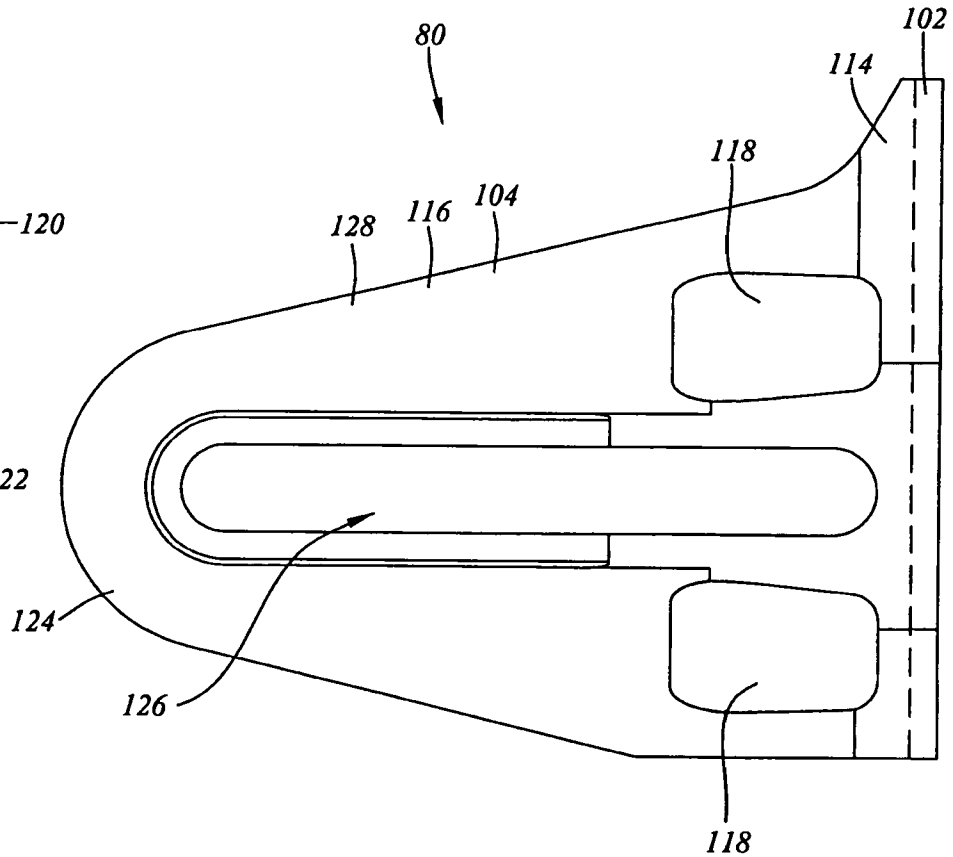
FIG. 4*c* is a plan view from one side of the front draft stop of FIG. 4*a;*
Figure 4E:
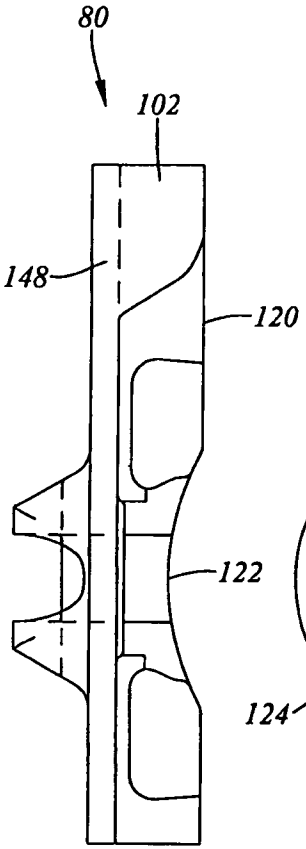
FIG. 4*e* is an end view of the front draft stop of FIG. 4*a;*

In FIG. **3*j*, the upper fillet 135 is shown before it is filled with one or more passes of weld metal. The lower fillet is shown in the as welded condition after one or more passes of weld metal have been laid down. This notional fillet weld is indicated in FIG. 3*j* by outline 150, and a notional heat affected zone (HAZ) in the adjacent material of front draft stop 80 and draft sill web 53 is indicated as 152. It may be that a first plane $P_1$ may be defined by the inside face 154 of web 53, and a second plane $P_2$ may be defined by the outside face 156 of web 53. The distance between these two planes, identified as $t_{53}$, is the thickness of web 53. The second plane may intersect flanks 40 at a point 158. A proxy for the width of the weld fillet may be defined as the distance along the second plane from edge 142 at the vertex formed with face 156 to point 158, identified as $t_{140}$. In one embodiment, the ratio of the thickness of the weld, for which $t_{140}$ may be used, may be less than 3 times the depth of the fillet, where that depth may be taken as $t_{53}$, the thickness of the draft sill web. In another embodiment that ratio may be less than 2:1. In another embodiment, that ratio may be about 1:1 to about 1.5:1. Another measure of weld thickness is the straight-line $t_{151}$ distance measured part way (some might say roughly half way) up the opposite flanks of the slot, or groove or valley to be filled as measured in plane 172**. That distance may be less than twice the depth of the fillet, and in one embodiment may be in the range of ½ to 1½ times the depth of the fillet.

Consider the weldment defined by fillet weld 150. This weldment may be thought of as having four sides, or interfaces, or boundaries, or boundary conditions. A first side 160 may be defined as being the region at which the weld pool melts into flank 140, and may, nominally, be thought of as lying along the line of flank 140 before welding occurs. A second portion or side 162 may be thought of as lying along the base of the fillet, and, for conceptual purposes may be taken as the line of the base portion of the fillet before welding occurs. A third portion or side 164 may be taken as the lying along the line of edge 142 of web 53. A fourth portion or side 166 may be taken as the exposed face of the weld pool extending, roughly speaking, from the outboard vertex of face 142 to point 158. The boundary condition along side 166 is a free condition, the boundary condition, after welding, along sides 160, 162, and 164 is a built-in condition. Weldment 150 fills the three sided "valley" between flank 140, and face 142. When a longitudinal load is imposed on front draft stop 80, 82, such as when the draft gear is loaded in draft, or if the coupler key bottoms at either end of slot 126, weldment 150 will be loaded in shear along both sides 160 and 162. A reaction will occur, in shear, along side 164. As may be noted, whereas side 162 is the side, or portion, adjacent to side 164, side 160 is opposed to side 164, and the center 170 of weldment 150 lies directly between the two opposed sides of the weld. That is, while the base of the weld is on a face substantially adjacent to face 142, flank 140 presents a face that is not adjacent, but rather opposed, to face 142, the projection of flank 140 at least partially falling outboard of plane $P_1$ of surface 154 and on face 142. It may be that no part of flank 140 presents a projection inboard of face 142. (The projection being in a direction lying in a the main plane of the web, be it, for example, the z or x direction). Expressed differently, a plane 172 can be constructed that passes through center 170 of weldment 150. Plane 172 may be substantially parallel to the planes $P_1$ and $P_2$ of face 154 and face 156. That plane 172 will intersect flank 140 and face 142 (and hence sides 160 and 164). Expressed differently again, no portion of the free side 166 of the weld pool lies laterally inboard of either center 170 or plane 172.

Rear Draft Stop 90, 92

Rear draft stop 90, is shown in greater detail in FIGS. 5*a* to 5*f*. Rear draft stop 92 is identical to front draft stop 90, but is of opposite hand. In that light, a description of rear draft stop 90 will be understood also to be a description of rear draft stop 92.

Rear draft stop 90 may be a monolithic casting or forging. These castings (or forgings) may be made of iron based materials, such as steel. Rear draft stop 90 may have the general form of an angle bracket 180, having a first leg 182, and a second leg 184, the first and second legs being oriented at right angles to each other. First leg 182 may tend, when installed, to stand inwardly proud of second leg 184, and may tend to present a surface 186 that is oriented to face away from second leg 184, and, in use, to face longitudinally outboard toward draft gear 72 and coupler 52. Surface 186 may define the contact interface that is abutment 96, and through which loads from the load transfer interface defined at the longitudinally inboard end of draft gear 72 are received.

Bracket 180 may also include reinforcements, or stiffeners 190, which may be webs 192 that support first leg 182, those stiffeners 190 extending from the back side of leg 182 (i.e., the side facing away from draft stop 72) toward, and merging into, second leg 184. Stiffeners 190 may be spaced apart along the back side of leg 182 to spread their support. Stiffeners 190 may have a generally triangular shape when viewed from above or below (when front draft stop 90, 92 is installed) with one side of the triangle merging into leg 182, another side merging into leg 184, and the third side defining the hypotenuse running between the other two. Stiffeners 190 may be relatively thick and squat in height from leg 184. Bracket 180 may also be thought of as a monolith having a thickened or wider end 194 at which leg 182 is formed, and a thinner or slimmer end region 196 distant therefrom. Even aside from stiffeners 190, the base thickness of second leg 184 may be thicker immediately adjacent to the junction with first leg 194, and may decrease in the direction away therefrom. That decrease may be on a linear taper, the taper may end at an intermediate location, as at 178. The thickened end 194 may have hollows, or depressions 198 formed therein with the walls that are left to either side of the depressions defining webs 192.

Second leg 184 may have a generally quadrilateral shape when seen in plan form. The base of this shape is located at the junction with first leg 182, and the shape may then taper to a shorter side located distantly therefrom at region 196. The taper may be only on one side, the upper side. The other three sides may be generally square to each other. Second leg 184 may include an inside face 202, namely the face to be placed next to web 53 of draft sill 50 on installation, typically in planar opposition thereto. Amidst face 202 there may be a peripherally extending built up portion, or protruding portion, or protruding member or boss 204, such as may tend to stand proud of face 202 and, when installed, may protrude laterally outboard through the associated accommodation 206 formed in web 53 of draft sill 50. Accommodation 206 may have generally the same profile as the outer periphery of boss 204, such that the one may fit inside, or be nested inside the other, as a male part in a female part, or inter-fitting positive and negative complementary images. Conceptually, boss 204 may be thought of as a protruding member standing proud of the surrounding planar portion of the outboard facing (when installed) surface of second leg 184. Alternatively, it may also be thought of conceptually as a plug having a shoulder, or shoulder array, that could include a plurality of separate segments, that is defined by the portion, or portions, of leg 184 that extend beyond the profile defined by accommodation 206, and hence will not pass through it. In that case, the peripheral shoulder or flange, or array of segments, tabs, tangs, or stubs, may be identified generically as a land, and may be identified as item 205 in the illustrations. Face 202 provides an example of such a land 205. Clearly, when land 205 meets the inside surface of web 53, boss 204 will protrude past that plane $P_1$ and will sit in accommodation 206, generally in the plane of web 53, i.e., lying between the two planes $P_1$ and $P_2$ defined by the surfaces of web 53, and, typically, extending past the plane of the central fiber, or neutral axis, of web 53, that plane being half way between the two other planes. It may be understood that, in the most general case, boss 204 be of such as height as also to extend past plane $P_2$, or, in a further alternate embodiment, to sit slightly shy of plane $P_2$.

It may be that the edge of accommodation 206 may be beveled or chamfered, or, alternatively, the peripherally extending side wall 207 of protruding boss 204 may be sloped, or chamfered, or beveled, or radiused as at 210, such as to form one side of a generally V-shaped or U-shaped fillet 215, such that a valley is formed of a suitable width and depth for receiving one or more passes of a fillet weld. Peripherally extending wall 207 may have substantially the same outline, or profile as the cut or exposed peripherally extending facing edge 212 of accommodation 206, but being offset inwardly with respect thereto, and, consequently being somewhat smaller. Peripherally extending wall 207 may then seat within facing edge 212 in the manner of a male plug seating within a female socket. Edge 212 may define the opposite side, or flank, of the U or V shaped valley or groove or fillet, the fillet is indicated notionally and generally as 215. The base wall of fillet 215 may be defined by the bottom, which may be a radiused bottom, 214 at the foot of the chamfer or radius at 210.

The generally v-shaped fillet 215 may be filled with weld metal. This weldment may be formed by an automatic welding machine. A further weldment may be formed around the outside periphery of second leg 184 more generally. That weldment may be made by an automatic welding machine working on the inboard, or inside face of web 53. To that end, the inside corner edge of leg 182 may be chamfered as at 208 to provide a weld fillet. This may be a conventional fillet in the sense of being made between a substantially planar surface (that of web 53), and the outstanding adjacent wall, or peripheral shoulder defined by peripheral face of leg 182. In a conceptual sense, the weld pass may be thought of as filling a corner where the peripheral face meets the plane.

Returning to the protruding portion, or boss, 204, a notional weldment in the nature of a fillet weld is indicated by outline 220, and a notional heat affected zone (HAZ) in the adjacent material of rear draft stop 90 and draft sill web 53 is indicated as 222. First and second planes $P_1$ and $P_2$ are as above. A proxy for the width of the weld fillet may be defined as the distance $t_{220}$ along the second plane $P_2$ from the vertex 216 of face 156 of web 53 at the corner of the formed profile of accommodation 206 to point 218, at which the weld fillet meets boss 204, which, for the purposes of this description may be either the point at which the profile of boss 204 traverses second plane $P_2$ or the point at which a tangent of the midpoint of the radiused profile of the sidewall of boss 204 intersects plane $P_2$ identified as $t_{220}$. In one embodiment, the ratio of the thickness of the weld, for which $t_{220}$ may be used, may be less than 3 times the depth of the fillet, where that depth may be taken as $t_{53}$, the thickness of the draft sill web. In another embodiment that ratio may be less than 2:1. In another embodiment, that ratio may be about 1:1 to about 1.5:1. Another measure of weld thickness is the straight-line $t_{221}$ distance measured halfway up the opposite flanks of the slot, or groove or valley to be filled, lying in plane 242. Plane 242 is the mid fiber plane of draft sill web 53, half way between planes $P_1$ and $P_2$ That distance may be less than twice the depth of the fillet, and in one embodiment may be in the range of ½ to 1½ times the depth of the fillet.

In cross-section, weldment 220 may be thought of as having four sides, or interfaces, or boundaries, or boundary conditions. A first side 230 may be defined as being the region at which the weld pool melts into side 207 of boss 204, and may, nominally, be thought of as side 207 before welding occurs. A second portion or side 232 may be thought of as lying along the base of the fillet, and, for conceptual purposes may be taken as the line of the base portion of the fillet before welding occurs. A third portion or side 234 may be taken as lying along the line of facing edge 212 of web 53. A fourth portion or side 236 may be taken as the exposed face of the weld puddle extending, roughly speaking, from the outboard vertex of facing edge 212 to point 218. The boundary condition along side 236 is a free condition, the boundary condition, after welding, along sides 230, 232, and 234 is a built-in condition. Weldment 220 fills the three sided "valley" between facing edge 212 and side 207. Along all four sides of boss 204, the fillet 215, or valley, or groove is (a) three sided, and (b) lies predominantly in the plane of (i.e., in the space between planes $P_1$ and $P_2$, of web 53.

Once the weld has been made, when a longitudinal load is imposed on rear draft stop 90, 92, such as when the draft gear is loaded in buff, weldment 220 will be loaded in compression between the longitudinally inboard, opposed facing portions 240 and 242 of wall 207 of boss 204 and facing edge 212 of web 53. This longitudinal compression occurs in the plane of web 53. That is to say, in a normal lap joint loaded in shear either perpendicular or parallel to the line of the joint, the force is transferred in shear, and the load is inherently eccentrically applied. By contrast, the throat of boss 204, which is in shear, is very large, having an area approximately equal to the profile outline of boss 204. Boss 204 is a very short cantilevered beam, in which the length $h_{204}$ of the beam is the height of the protrusion, which, nominally, may be substantially the same as the thickness of web 53, and, if the depth of the beam is taken to be the dimension parallel to the direction of applied force, signified by $d_{204}$, the resulting beam has a length to depth aspect ratio of substantially less then 1:1. This ratio may be less than 0.20:1. The load then applied by boss 204 to web 53 may tend to be an in-plane, generally centric force, or a force whose central line of action may tend to fall between planes $P_1$ and $P_2$, with a significantly lower component of force tending to shear or locally twist web 53 than what might otherwise be the case.

By way of comparison, the cross sectional area of the profile of boss 204 may be taken, when installed, as being the cross-sectional area of boss 204 at the middle plane 235 of web 53, and may be designated $A_{204}$. Alternatively, a characteristic cross-sectional area may be taken as the cross-sectional area $A_{mid}$ at a mid-height point on the fillet flanks half way from the plane $P_{205}$ defined by the surrounding shoulder or land 205, and the parallel plane $P_{203}$ of the outermost end surface 203 of boss 204. (Clearly, if the height of boss 204, $h_{204}$, is the same as the through thickness of web 53, plane $P_{203}$ will be the same as $P_2$, and $A_{204}$ will be the same as $A_{mid}$.) A characteristic weld area $A_{221}$ may be defined by multiplying the weld arc length, $L_w$, by a characteristic width W. The characteristic width W may be taken as the distance $t_{221}$, being the fillet weld thickness measured half way up the fillet sides or flanks in plane 235. Weld arc length $L_w$ may be taken, approximately, as the arc length $L_{207}$ of peripheral wall 207 at its mid height point (i.e., in plane 235) plus ($\pi \times t_{221}$). I.e., $A_{221}=L_w, \times t_{221}$. A ratio of either $A_{204}$ or $A_{mid}$ to this proxy for, or notional measure of, weld area $A_{221}$ may be substantially greater than 1:1. In one embodiment it may be greater than 5:2, and in one embodiment it may lie in the range of 3:1 to 8:1. Similarly, another proxy for weld area, $A_{207}$ may be taken as the arc length $L_{207}$ of peripheral face 207, measured at the mid height location on boss 204, plus 8 times the height of the boss, $h_{204}$, all multiplied by the height $h_{204}$ of boss 204. I.e., $A_{207}=(L_{207}+8\ h_{204})\times h_{204}$. A ratio of either $A_{204}$ or $A_{mid}$ to $A_{207}$ may be significantly greater than 1:1. In one embodiment it may be greater than 5:2, and in another embodiment it may lie in the range of 3:1 to 8:1.

Similarly, between the longitudinally outboard, opposed facing portions 244 and 246 of wall 207 of boss 204 and facing edge 212 of web 53, the longitudinally outboard portion of weldment 220 may be predominantly in tension, but that tension may tend to be in the plane of web 53 (i.e., applied generally in the in-plane longitudinal direction between planes $P_1$ and $P_2$).

Along the upper edge, between the opposed facing portions 248 and 250 of wall 207 of boss 204 and facing edge 212 of web 53, the upper portion of weldment 220 may tend predominantly to be in shear, but that shear may tend to be applied significantly, or predominantly, in the plane of web 53 (i.e., applied generally in the in-plane longitudinal direction between planes $P_1$ and $P_2$), since the opposite sides of the weld associated with portions 248 and 250 are located there. To the extent that the upper edge, or portion of the groove or valley defining peripherally extending fillet 215 may be on a tapered incline, which may extend generally downwardly and longitudinally inboard, such that when loaded in buff, boss 204 may tend to wedge into accommodation 206 all the more so, which may tend to generate a secondary compressive stress normal to facing portions 248 and 250. In an alternate embodiment, boss 204 need not necessarily have a tapered or wedge shaped footprint, but may have a square, rectangular, or hour-glass shaped footprint that may not necessarily have a wedging effect.

Along the lower edge, between the opposed facing portions 252 and 254 of wall 207 of boss 204 and facing edge 212 of web 53, the lower portion of weldment 220 may tend predominantly to be in shear, but that shear may tend to be applied significantly, or predominantly, in the plane of web 53 (i.e., applied generally in the in-plane longitudinal direction between planes $P_1$ and $P_2$), since the opposite sides of the weld associated with portions 252 and 254 are located in that region. To the extent that the reaction to the wedging of the upper portion of weldment 220 may be provided at the lower edge, or portion of the groove or valley defining peripherally extending fillet 215 a secondary compressive stress normal to facing portions 252 and 254 may also be generated. Fillet 215 is shown in the upper portion of FIG. 3*l* before welding, and in the lower portion after welding.

The upper and lower portions of weldment 220 may be loaded in shear in a manner not unlike the manner in which the longitudinally running portions of weldment 150 are loaded. That is, out-of-plane, local rotational strain (e.g., about the z, or vertical axis) may tend to be discouraged by the welded connection along opposite faces of the fillet or valley, and such shearing tendency as may urge rotational motion may tend to be predominantly about a horizontal or y-axis.

Consider lower portion 245 of weldment 220 as being representative of a weld that is subject to a predominantly shearing force when second leg 182 is driven longitudinally inboard in buff, and the reaction is supplied by web 53.

In cross-section, weldment 220 may be thought of as having four sides, or interfaces, or boundaries, or boundary conditions. A first side 230 may be defined as being the region at which the weld pool melts into side 207 of boss 204, and may, nominally, be thought of as side 207 before welding occurs. A second portion or side 232 may be thought of as lying along the base of the fillet, and, for conceptual purposes may be taken as the line of the base portion of the fillet before welding occurs. A third portion or side 234 may be taken as lying along the line of facing edge 212 of web 53. A fourth portion or side 236 may be taken as the exposed face of the weld puddle extending, roughly speaking, from the outboard vertex of facing edge 212 to point 218. The boundary condition along side 236 is a free condition, the boundary condition, after welding, along sides 230, 232, and 234 is a built-in condition. Weldment 220 fills the three sided "valley" between facing edge 212 and side 207. Along all four sides of boss 204, the fillet, or valley, or groove is (a) three sided, and (b) lies predominantly in the plane of (i.e., in the space between planes $P_1$ and $P_2$, of web 53.

A reaction will occur, in shear, along the base portion of the weld, identified as side 232. As may be noted, whereas side 232 is the side, or portion adjacent side 234, side 230 is opposed to side 234, and the center 239 of weldment 220 lies directly between the two opposed sides of the weld. That is, while the base of the weld is on a face substantially adjacent to face 212, peripheral wall 207 presents a face that is not adjacent but rather opposed to face 212, the projection of peripheral wall 207 in any in-plane direction relative to web 53 at least partially falling outboard of plane $P_1$ and inboard of plane $P_2$. It may be that no part of wall 207 presents a projection inboard of face 212. Expressed differently, plane 235 passes through center 239 of weldment 220. Plane 235 may be substantially parallel to the planes $P_1$ of face 154 and $P_2$ of face 156. That plane 235 will intersect peripheral wall 207 and face 212 (and hence sides 230 and 234). Expressed differently again, no portion of the free side 236 of the weld pool lies laterally inboard of either center 239 or plane 242. In weldment 220, a shearing force acting along the line of the weld (or predominantly therealong), through opposed faces 230 and 234 may tend to urge portions of weldment 220 to want to rotate about an axis that is generally or predominantly out-of plane to, if not normal to, plane 235. In this sense, the shear can be thought of as acting in the plane of the mating parts.

Alternate Embodiments

Figure 5A:
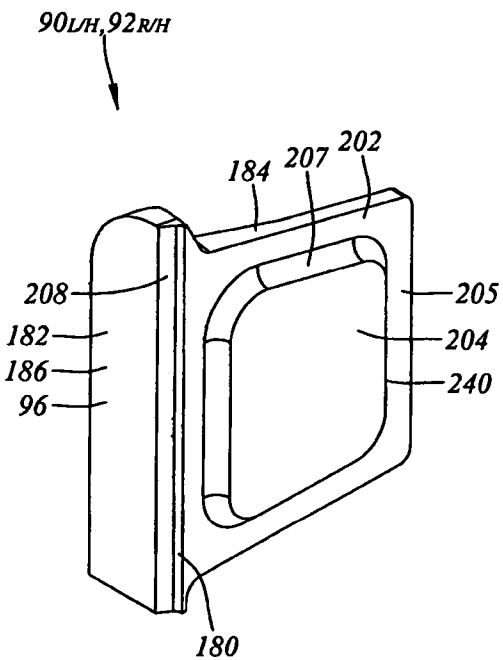
FIG. 5*a* shows an isometric view of a rear draft stop of the assembly of FIG. 3*a;*
Figure 5C:
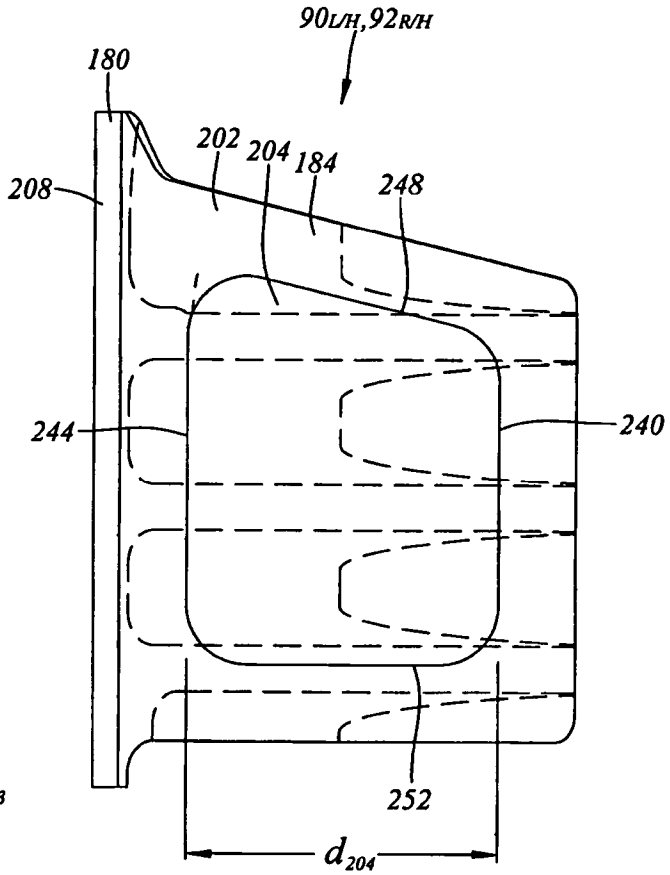
FIG. 5*c* is a plan view from one side of the rear draft stop of FIG. 5*a;*
Figure 5E:
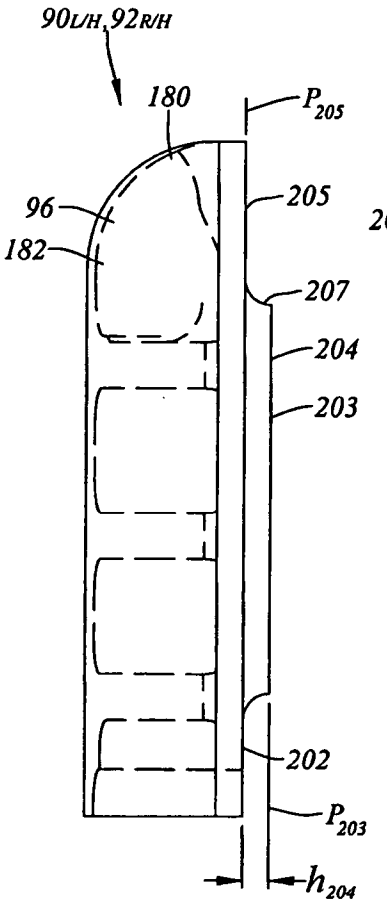
FIG. 5*e* is an end view of the rear draft stop of FIG. 5*a;*
Figure 5B:
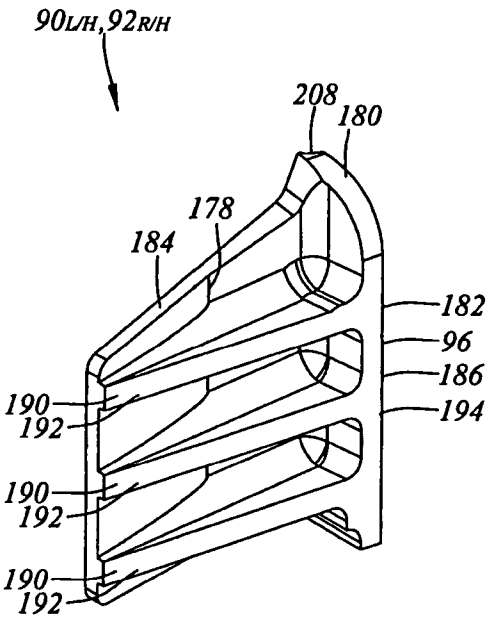
FIG. 5*b* is an isometric view of an opposite face of the rear draft stop of FIG. 5*a;*
Figure 5D:
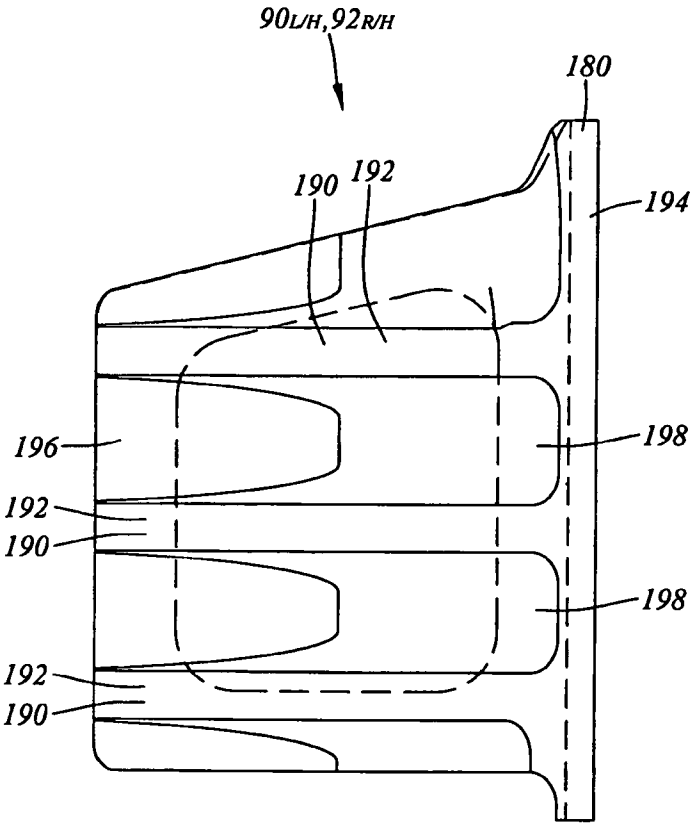
FIG. 5*d* is a plan view of the opposite side of the rear draft stop of FIG. 5*c;*
Figure 5F:
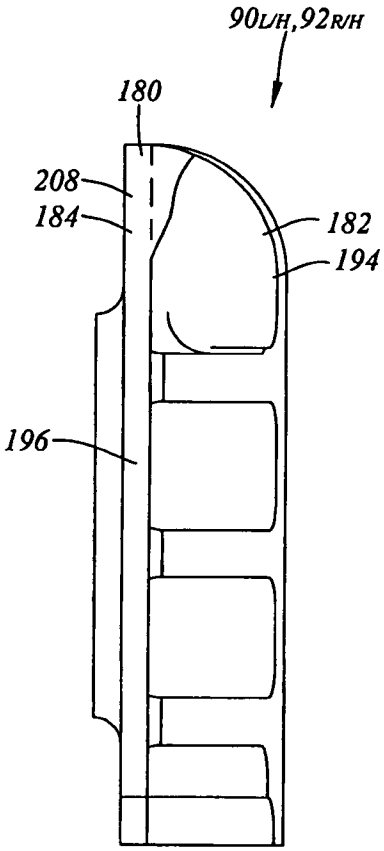
FIG. 5*f* is an opposite end view of the rear draft stop of FIG. 5*e;*
Figure 5G:
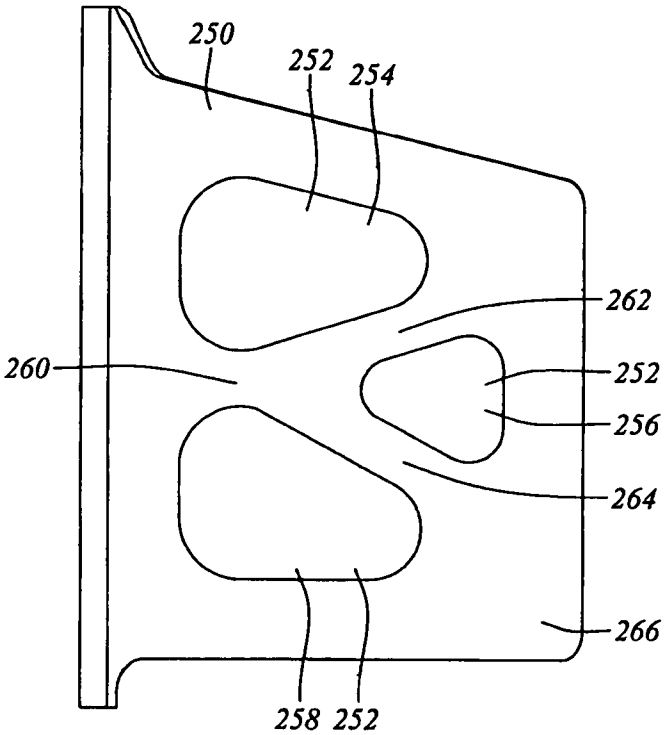
FIG. 5*g* shows an alternate embodiment to that of FIG. 5*c*.
Figure 5H:
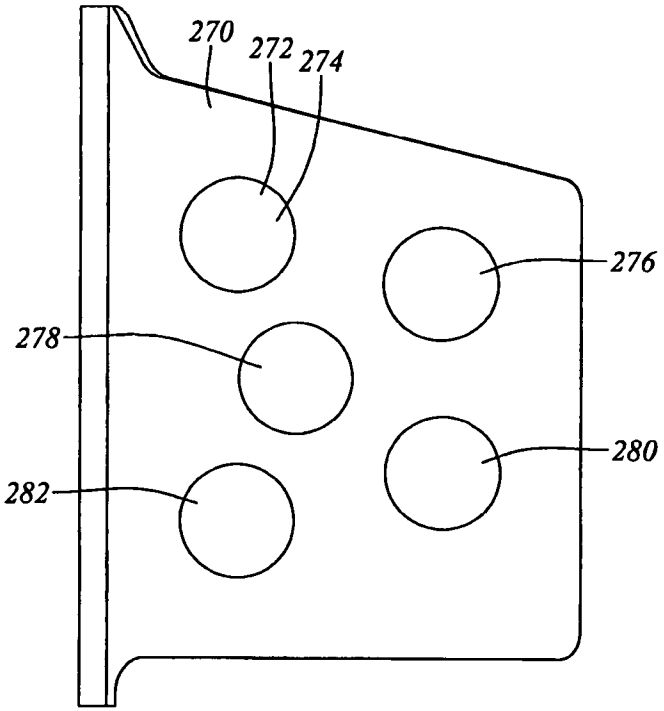
FIG. 5*h* shows another alternate embodiment to that of FIG. 5*c.*

FIGS. 5*g* and 5*h* show alternate embodiments of rear draft stops. In FIG. 5*g*, a rear draft stop 250 is generally similar to rear draft stop 90 or 92, but differs in having an array 252 of bosses 254, 256, 258. Each of bosses 254, 256 and 258 may be generally triangular in profile, and the overall footprint of all of the elements of array 252 may occupy substantially the same general footprint as boss 204. In this case, there may be interstitial regions 260, 262, 264 in the form of rebates or grooves or channels, whose bases may be in the same, or substantially the same plane as, and may be considered to be sub-regions or extensions of, the surrounding land 266. Web 53 may be provided with an accommodation having the negative image that mates with array 252, with interstitial web portions that seat in regions 260, 262 and 264. As with boss 204, the general shape of the triangular portions may tend to promote a wedging effect when buff loads are applied. The height of the individual elements of array 252 may be the same as that of boss 204. The proportionate areas, and ratios of areas of weld metal fillets and boss cross-sections may differ from those described above, with the ratio being more nearly equal. That is, analogous weld fillet arc lengths and areas can be calculated based on an arc length offset from the periphery of each of the elements by either (a) ½ of the actual fillet width before welding; or (b) the height of the boss (on the assumption that the height of the boss is a reasonable proxy for the half width of the fillet). The area is then determined by multiplying that arc length by the height of the boss, on the same assumption that the height of the boss is a proxy for the effective width of the fillet. In the case of stop 250, the area of the bass of the bosses may be in the range of about ½ or ¾ to about 2½ or 3 times the deemed fillet area.

In the embodiment of FIG. 5*h*, a rear draft stop 270 is, again, substantially the same as rear draft stop 90, or 92 (or 250, for that matter), and has an array 272 of bosses 274, 276, 278, 280, 282. In this instance, bosses 274, 276, 278, 280, 282 may each have a circular plan form. Web 53 may then be provided with a mating negative, or female, formation of bores defining an accommodation, or accommodation array, to which array 272 may be mated, and welded. Analogous areas may be calculated. The general arrangement of bosses may tend to have the wedging effect under buff loading discussed above.

Thus, the protruding portion of the rear draft stop may be a single boss, or it may include two or more bosses. The boss, or bosses, however many there may be, may be arranged in a wedging pattern. The wedging pattern may tend to have a wider spread or footprint more closely adjacent to the draft gear to rear draft stop load transfer interface, defined by the first leg, and a narrower spread or footprint more distant therefrom. In each case the boss or bosses, as may be, when installed, will stand proud of the plane of the surrounding shoulder or land, or land array, and will extend beyond plane $P_1$, such that when a weldment is formed, there will be a force transfer interface that is opposed to, (as distinct from a portion adjacent to but lying shy of or flush with plane $P_1$), a facing portion of the mating web. In this definition, the opposed flanks of a sharp v-notch would be considered to be opposed, to the extent that the flank of the V-notch defined by the boss (or bosses) may lie beyond plane $P_1$. The projection of the boss, or bosses past the facing surface of the draft sill web may tend to result in at least a portion of the resulting weldment being, predominantly, in longitudinal compression in the plane of the web.

In the front and rear draft stop embodiments described, the fillets have had sloped or chamfered, or radiused sides, and the production process has included laying one or more fillet weld passes along the fillet to build up an appropriate weld. The opposed sides of the weld fillet valley need not be divergent, but rather, parallel sides may be used. For example, a submerged arc welding step may be employed with a parallel sided fillet, or square sided groove, as it may be termed.

Various embodiments have been described in detail. Since changes in and or additions to the above-described examples may be made without departing from the nature, spirit or scope of the invention, the invention is not to be limited to those details.

I claim:

1. A draft assembly for a rail road freight car, said draft assembly comprising:

a draft sill having a draft pocket defined therewithin in which draft gear may be mounted, said draft sill having a first end adjacent a center plate, and a second end longitudinally outboard of, and distant from the center plate;

said draft sill having a pair of first and second draft sill walls, said first and second draft sill walls being spaced apart to accommodate draft gear therebetween;

first and second front draft stops, said first front draft stop being mounted to said first draft sill wall, said second front draft stop being mounted to said second draft sill wall;

first and second rear draft stops, said first rear draft stop being mounted to said first draft sill wall, said second rear draft stop being mounted to said second draft sill wall;

said first and second rear draft stops being longitudinally inboard of said first and second front draft stops;

said first and second front draft stops being different from said first and second rear draft stops in having a coupler key aperture formed therethrough;

said first draft sill wall having a first face oriented inwardly relative to said draft pocket;

said first draft sill wall having an accommodation formed therein;

said first rear draft stop having a first interface defining a seat against which draft gear mounted in said draft pocket may work in buff;

said first rear draft stop having a second interface cooperably engageable with said first draft sill wall;

said second interface including a first portion for seating against said first face of said first draft sill wall;

said second interface including a second portion that extends proud of said first portion, said second portion of said second interface being seatable within said accommodation formed in said first draft sill wall; and in operation, said first rear draft stop being operable to receive loads from draft gear at said first interface, and operable to transmit loads between said second interface and said first draft sill wall.

2. The draft assembly of claim 1 wherein said accommodation includes an aperture formed through said first draft sill wall.

3. The draft assembly of claim 1 wherein said accommodation includes an aperture formed in said first draft sill wall, said aperture has a profile, and said second portion of said second interface of said first rear draft stop has a footprint shaped to correspond to said profile of said aperture.

4. The draft assembly of claim 1 wherein said accommodation has a narrowing profile, and said second portion of said second interface has a corresponding narrowing profile.

5. The draft assembly of claim 4 wherein said accommodation narrows from a broader end to a narrower end, said second portion of said second interface narrows from a broader end to a narrower end, and said narrower end of said second portion of said second interface is more distant from said first interface of said first rear draft stop than is said broader end of said second portion of said second interface of said first rear draft stop.

6. The draft assembly of claim 1 wherein said first rear draft stop is welded to said first draft sill wall with said second portion of said second interface of said first rear draft stop seated in said accommodation.

7. The draft assembly of claim 6 wherein said second portion of said second interface has a periphery, and said second portion of said second interface is welded into said accommodation about said periphery.

8. The draft assembly of claim 1 wherein said accommodation includes an aperture formed through said first draft sill wall, said second portion of said second interface includes a protrusion seated within said aperture, said protrusion has a periphery, and said protrusion is welded within said aperture about said periphery.

9. The draft assembly of claim 1 wherein said first draft sill wall has a through thickness, and said second portion of said second interface of said first rear draft stop stands proud of said first portion of said second interface of said first draft rear stop a distance corresponding substantially to said through thickness of said first draft sill wall.

10. The draft assembly of claim 1 wherein said first draft sill wall has a first margin for cooperation with a draft sill upper flange, and a second margin distant therefrom, said accommodation is a rebate formed through said first draft sill wall, said rebate has an entrance formed in said second margin, and said first rear draft stop can be introduced into said accommodation through said entrance at said second margin.

11. The draft assembly of claim 1 wherein said accommodation includes an aperture having a closed periphery and said second portion of said second interface is a boss having a shape formed to fit within said periphery.

12. A rear draft stop for mounting inside a draft sill of a railroad freight car, the rear draft stop being free of any coupler key slot, the rear draft stop having a first interface at which to receive draft loads in buff, and a second interface at which to transmit draft loads to the draft sill, said first and second interfaces being structurally interconnected; the second interface having first and second draft sill web engagement portions, the first draft sill web engagement portion being locatable against a face of a draft sill wall, and the second draft sill web engagement portion standing proud of the first draft sill web engagement portion.

13. The rear draft stop of claim 12 wherein:

said first portion of said second interface has a footprint;

a closed peripheral boundary is defined by a line of shortest length enclosing said footprint; and, when viewed perpendicular to a normal projection of said footprint said second portion has a centroid; and said centroid lies within said closed peripheral boundary.

14. The rear draft stop of claim 12 wherein said first portion of said second interface includes three contact points lying in a plane and said second portion of said second interface includes a protrusion standing proud of said plane.

15. The rear draft stop of claim 12 wherein, when seen looking toward said second interface in a direction normal to said first portion of said second interface, said second portion of said second interface has a narrowing profile.

16. The rear draft stop of claim 12 wherein said second portion of said second interface narrows from a broader part to a narrower part, and said narrower part of said second portion of said second interface is more distant from said first interface of said rear draft stop than is said broader part of said second portion of said second interface.

17. The rear draft stop of claim 12 wherein said second portion of said second interface is chamfered to form a fillet into which passes of weldmetal can be introduced.

18. The rear draft stop of claim 12 wherein said second portion of said second interface is a boss, said first portion of said second interface defines a peripheral land extending about said boss and defining a shoulder.

19. A rear draft stop for mounting inside a draft sill of a railroad freight car, the rear draft stop being free of any coupler key slot, the rear draft stop having a first interface at which to receive draft loads in buff, and a second interface at which to transmit draft loads to the draft sill, said first and second interfaces being structurally interconnected; the second interface having first and second draft sill web engagement portions, the first draft sill web engagement portion being locatable against a face of a draft sill wall, the second draft sill web engagement portion standing proud of the first draft sill web engagement portion; said first portion of said second interface includes a substantially planar surface for abutment against a draft sill wall and said second portion of said second interface includes a boss standing proud of said substantially planar interface.

20. The rear draft stop of claim 19 wherein said second interface includes at least two bosses.

21. The rear draft stop of claim 20 wherein said second interface includes at least three bosses.

22. The rear draft stop of claim 21 wherein said first portion of said second interface defines a footprint, and said footprint of said first portion extends continuously about said second portion of said second interface.

23. A rear draft stop for mounting inside a draft sill of a railroad freight car, the rear draft stop having a first interface at which to receive draft loads in buff, and a second interface at which to transmit draft loads to the draft sill, said first and second interfaces being structurally interconnected; the second interface having first and second draft sill web engagement portions, the first draft sill web engagement portion being locatable against a face of a draft sill wall, and the second draft sill web engagement portion standing proud of the first draft sill web engagement portion.

24. The rear draft stop of claim 23 wherein:

said first portion of said second interface has a footprint;

a closed peripheral boundary is defined by a line of shortest length enclosing said footprint; and, when viewed perpendicular to a normal projection of said footprint said second portion has a centroid; and said centroid lies within said closed peripheral boundary.

25. The rear draft stop of claim 23 wherein said first portion of said second interface includes three contact points lying in a plane and said second portion of said second interface includes a protrusion standing proud of said plane.

26. The rear draft stop of claim 23 wherein, when seen looking toward said second interface in a direction normal to said first portion of said second interface, said second portion of said second interface has a narrowing profile.

27. The rear draft stop of claim 23 wherein said second portion of said second interface narrows from a broader part to a narrower part, and said narrower part of said second portion of said second interface is more distant from said first interface of said rear draft stop than is said broader part of said second portion of said second interface.

28. The rear draft stop of claim 23 wherein said second portion of said second interface is chamfered to form a fillet into which passes of weldmetal can be introduced.

29. The rear draft stop of claim 23 wherein said second portion of said second interface is a boss, said first portion of said second interface defines a peripheral land extending about said boss and defining a shoulder.

* * * * *